US007034783B2

(12) United States Patent
Gates et al.

(10) Patent No.: US 7,034,783 B2
(45) Date of Patent: Apr. 25, 2006

(54) METHOD FOR CONTROLLING ELECTRO-OPTIC DISPLAY

(75) Inventors: Holly G. Gates, Somerville, MA (US); Karl R. Amundson, Cambridge, MA (US)

(73) Assignee: E Ink Corporation, Cambridge, MA (US)

( * ) Notice: Subject to any disclaimer, the term of this patent is extended or adjusted under 35 U.S.C. 154(b) by 0 days.

(21) Appl. No.: 10/921,630

(22) Filed: Aug. 19, 2004

(65) Prior Publication Data

US 2005/0041004 A1 Feb. 24, 2005

Related U.S. Application Data

(60) Provisional application No. 60/481,258, filed on Aug. 19, 2003, provisional application No. 60/481,262, filed on Aug. 19, 2003.

(51) Int. Cl.
*G09G 3/34* (2006.01)

(52) U.S. Cl. ..... 345/84; 345/94; 345/105; 345/107

(58) Field of Classification Search ..... 345/84–107, 345/211–212; 349/86
See application file for complete search history.

(56) References Cited

U.S. PATENT DOCUMENTS

| | | | | |
|---|---|---|---|---|
| 3,668,106 | A | 6/1972 | Ota | |
| 3,756,693 | A | 9/1973 | Ota | |
| 3,767,392 | A | 10/1973 | Ota | |
| 3,792,308 | A | 2/1974 | Ota | |
| 3,870,517 | A | 3/1975 | Ota et al. | |
| 3,892,568 | A | 7/1975 | Ota | |
| 3,972,040 | A | 7/1976 | Hilsum et al. | |
| 4,041,481 | A | 8/1977 | Sato | |
| 4,418,346 | A | 11/1983 | Batchelder | |
| 4,430,648 | A | 2/1984 | Togashi et al. | |
| 4,450,440 | A | 5/1984 | White | |
| 4,697,887 | A * | 10/1987 | Okada et al. | 345/96 |
| 4,741,604 | A | 5/1988 | Kornfeld | |
| 4,746,917 | A | 5/1988 | Di Santo et al. | |

(Continued)

FOREIGN PATENT DOCUMENTS

DE 25 23 763 12/1976

(Continued)

OTHER PUBLICATIONS

Amundson, K., et al., "Flexible, Active-Matrix Display Constructed Using a Microencapsulated Electrophoretic Material and an Organic-Semiconductor-Based Backplane", SID 01 Digest, 160 (Jun. 2001).

(Continued)

*Primary Examiner*—Sumati Lefkowitz
*Assistant Examiner*—Rodney Amadiz
(74) *Attorney, Agent, or Firm*—David J. Cole

(57) ABSTRACT

An electro-optic display comprises a bistable electro-optic medium, a plurality of pixel electrodes, with associated non-linear elements, and a common electrode, disposed on opposed sides of the electro-optic medium. The display has a writing mode, in which at least two different voltages are applied to different pixel electrodes, and a non-writing mode in which the voltages applied to the pixel electrodes are controlled so that any image previously written on the electro-optic medium is substantially maintained. The display is arranged to apply to the common electrode a first voltage when the display is in its writing mode and a second voltage, different from the first voltage, when the display is in its non-writing mode.

25 Claims, 6 Drawing Sheets

U.S. PATENT DOCUMENTS

| | | | | |
|---|---|---|---|---|
| 4,833,464 | A | 5/1989 | Di Santo et al. | |
| 4,947,157 | A | 8/1990 | Di Santo et al. | |
| 4,947,159 | A | 8/1990 | Di Santo et al. | |
| 5,066,946 | A | 11/1991 | Disanto et al. | |
| 5,223,115 | A | 6/1993 | DiSanto et al. | |
| 5,247,290 | A | 9/1993 | DiSanto et al. | |
| 5,254,981 | A | 10/1993 | DiSanto et al. | |
| 5,266,937 | A | 11/1993 | DiSanto et al. | |
| 5,293,528 | A | 3/1994 | DiSanto et al. | |
| 5,302,235 | A | 4/1994 | DiSanto et al. | |
| 5,343,217 | A * | 8/1994 | Kim | 345/95 |
| 5,412,398 | A | 5/1995 | DiSanto et al. | |
| 5,467,107 | A | 11/1995 | DiSanto et al. | |
| 5,467,217 | A | 11/1995 | Check, III | |
| 5,499,038 | A | 3/1996 | DiSanto et al. | |
| 5,539,546 | A * | 7/1996 | Koden et al. | 349/86 |
| 5,654,732 | A | 8/1997 | Katakura | |
| 5,684,501 | A | 11/1997 | Knapp et al. | |
| 5,689,282 | A | 11/1997 | Wolfs et al. | |
| 5,706,023 | A * | 1/1998 | Nagata et al. | 345/92 |
| 5,717,515 | A | 2/1998 | Sheridon | |
| 5,739,801 | A | 4/1998 | Sheridon | |
| 5,745,094 | A | 4/1998 | Gordon, II et al. | |
| 5,751,266 | A | 5/1998 | Crossland et al. | |
| 5,760,761 | A | 6/1998 | Sheridon | |
| 5,777,782 | A | 7/1998 | Sheridon | |
| 5,808,783 | A | 9/1998 | Crowley | |
| 5,866,284 | A | 2/1999 | Vincent | |
| 5,872,552 | A | 2/1999 | Gordon, II et al. | |
| 5,892,504 | A | 4/1999 | Knapp | |
| 5,896,117 | A | 4/1999 | Moon | |
| 5,930,026 | A | 7/1999 | Jacobson et al. | |
| 5,933,203 | A | 8/1999 | Wu et al. | |
| 5,961,804 | A | 10/1999 | Jacobson et al. | |
| 5,963,456 | A | 10/1999 | Klein et al. | |
| 5,978,052 | A | 11/1999 | Ilcisin et al. | |
| 6,002,384 | A | 12/1999 | Tamai et al. | |
| 6,017,584 | A | 1/2000 | Albert et al. | |
| 6,034,807 | A | 3/2000 | Little et al. | |
| 6,054,071 | A | 4/2000 | Mikkelsen, Jr. | |
| 6,055,091 | A | 4/2000 | Sheridon et al. | |
| 6,055,180 | A | 4/2000 | Gudesen et al. | |
| 6,057,814 | A | 5/2000 | Kalt | |
| 6,064,410 | A | 5/2000 | Wen et al. | |
| 6,067,185 | A | 5/2000 | Albert et al. | |
| 6,081,285 | A | 6/2000 | Wen et al. | |
| 6,097,531 | A | 8/2000 | Sheridon | |
| 6,118,426 | A | 9/2000 | Albert et al. | |
| 6,120,588 | A | 9/2000 | Jacobson | |
| 6,120,839 | A | 9/2000 | Comiskey et al. | |
| 6,124,851 | A | 9/2000 | Jacobson | |
| 6,128,124 | A | 10/2000 | Silverman | |
| 6,130,773 | A | 10/2000 | Jacobson et al. | |
| 6,130,774 | A | 10/2000 | Albert et al. | |
| 6,137,467 | A | 10/2000 | Sheridon et al. | |
| 6,144,361 | A | 11/2000 | Gordon, II et al. | |
| 6,147,791 | A | 11/2000 | Sheridon | |
| 6,154,190 | A | 11/2000 | Yang et al. | |
| 6,172,798 | B1 | 1/2001 | Albert et al. | |
| 6,177,921 | B1 | 1/2001 | Comiskey et al. | |
| 6,184,856 | B1 | 2/2001 | Gordon, II et al. | |
| 6,211,998 | B1 | 4/2001 | Sheridon | |
| 6,225,971 | B1 | 5/2001 | Gordon, II et al. | |
| 6,232,950 | B1 | 5/2001 | Albert et al. | |
| 6,236,385 | B1 | 5/2001 | Nomura et al. | |
| 6,239,896 | B1 | 5/2001 | Ikeda | |
| 6,241,921 | B1 | 6/2001 | Jacobson et al. | |
| 6,249,271 | B1 | 6/2001 | Albert et al. | |
| 6,252,564 | B1 | 6/2001 | Albert et al. | |
| 6,262,706 | B1 | 7/2001 | Albert et al. | |
| 6,262,833 | B1 | 7/2001 | Loxley et al. | |
| 6,271,823 | B1 | 8/2001 | Gordon, II et al. | |
| 6,300,932 | B1 | 10/2001 | Albert | |
| 6,301,038 | B1 | 10/2001 | Fitzmaurice et al. | |
| 6,312,304 | B1 | 11/2001 | Duthaler et al. | |
| 6,312,971 | B1 | 11/2001 | Amundson et al. | |
| 6,320,565 | B1 | 11/2001 | Albu et al. | |
| 6,323,989 | B1 | 11/2001 | Jacobson et al. | |
| 6,327,072 | B1 | 12/2001 | Comiskey et al. | |
| 6,330,054 | B1 | 12/2001 | Ikami | |
| 6,348,908 | B1 | 2/2002 | Richley et al. | |
| 6,359,605 | B1 | 3/2002 | Knapp et al. | |
| 6,373,461 | B1 | 4/2002 | Hasegawa et al. | |
| 6,376,828 | B1 | 4/2002 | Comiskey | |
| 6,377,387 | B1 | 4/2002 | Duthaler et al. | |
| 6,392,785 | B1 | 5/2002 | Albert et al. | |
| 6,392,786 | B1 | 5/2002 | Albert | |
| 6,407,763 | B1 | 6/2002 | Yamaguchi et al. | |
| 6,413,790 | B1 | 7/2002 | Duthaler et al. | |
| 6,421,033 | B1 | 7/2002 | Williams et al. | |
| 6,422,687 | B1 | 7/2002 | Jacobson | |
| 6,445,374 | B1 | 9/2002 | Albert et al. | |
| 6,445,489 | B1 | 9/2002 | Jacobson et al. | |
| 6,459,418 | B1 | 10/2002 | Comiskey et al. | |
| 6,462,837 | B1 | 10/2002 | Tone | |
| 6,473,072 | B1 | 10/2002 | Comiskey et al. | |
| 6,480,182 | B1 | 11/2002 | Turner et al. | |
| 6,498,114 | B1 | 12/2002 | Amundson et al. | |
| 6,504,524 | B1 | 1/2003 | Gates et al. | |
| 6,506,438 | B1 | 1/2003 | Duthaler et al. | |
| 6,512,354 | B1 | 1/2003 | Jacobson et al. | |
| 6,515,649 | B1 | 2/2003 | Albert et al. | |
| 6,518,949 | B1 | 2/2003 | Drzaic | |
| 6,521,489 | B1 | 2/2003 | Duthaler et al. | |
| 6,531,997 | B1 | 3/2003 | Gates et al. | |
| 6,535,197 | B1 | 3/2003 | Comiskey et al. | |
| 6,538,801 | B1 | 3/2003 | Jacobson et al. | |
| 6,545,291 | B1 | 4/2003 | Amundson et al. | |
| 6,580,545 | B1 | 6/2003 | Morrison et al. | |
| 6,639,578 | B1 | 10/2003 | Comiskey et al. | |
| 6,652,075 | B1 | 11/2003 | Jacobson | |
| 6,657,772 | B1 | 12/2003 | Loxley | |
| 6,664,944 | B1 | 12/2003 | Albert et al. | |
| D485,294 | S | 1/2004 | Albert | |
| 6,672,921 | B1 | 1/2004 | Liang et al. | |
| 6,680,725 | B1 | 1/2004 | Jacobson | |
| 6,683,333 | B1 | 1/2004 | Kazlas et al. | |
| 6,693,620 | B1 | 2/2004 | Herb et al. | |
| 6,704,133 | B1 | 3/2004 | Gates et al. | |
| 6,710,540 | B1 | 3/2004 | Albert et al. | |
| 6,721,083 | B1 | 4/2004 | Jacobson et al. | |
| 6,724,519 | B1 | 4/2004 | Comiskey et al. | |
| 6,727,881 | B1 | 4/2004 | Albert et al. | |
| 6,738,050 | B1 | 5/2004 | Comiskey et al. | |
| 6,750,473 | B1 | 6/2004 | Amundson et al. | |
| 6,753,999 | B1 | 6/2004 | Zehner et al. | |
| 6,788,449 | B1 | 9/2004 | Liang et al. | |
| 6,816,147 | B1 | 11/2004 | Albert | |
| 6,819,471 | B1 | 11/2004 | Amundson et al. | |
| 6,822,782 | B1 | 11/2004 | Honeyman et al. | |
| 6,825,068 | B1 | 11/2004 | Denis et al. | |
| 6,825,829 | B1 | 11/2004 | Albert et al. | |
| 6,825,970 | B1 | 11/2004 | Goenaga et al. | |
| 6,831,769 | B1 | 12/2004 | Holman et al. | |
| 6,839,158 | B1 | 1/2005 | Albert et al. | |
| 6,842,167 | B1 | 1/2005 | Albert et al. | |
| 6,842,279 | B1 | 1/2005 | Amundson | |
| 6,842,657 | B1 | 1/2005 | Drzaic et al. | |
| 6,864,875 | B1 | 3/2005 | Drzaic et al. | |
| 6,865,010 | B1 | 3/2005 | Duthaler et al. | |
| 6,866,760 | B1 | 3/2005 | Paolini, Jr. et al. | |
| 6,870,657 | B1 | 3/2005 | Fitzmaurice et al. | |
| 6,870,661 | B1 | 3/2005 | Pullen et al. | |
| 2001/0026260 | A1 | 10/2001 | Yoneda et al. | |

| | | | |
|---|---|---|---|
| 2002/0005832 | A1 | 1/2002 | Katase |
| 2002/0033784 | A1 | 3/2002 | Machida et al. |
| 2002/0033793 | A1 | 3/2002 | Machida et al. |
| 2002/0060321 | A1 | 5/2002 | Kazlas et al. |
| 2002/0063661 | A1 | 5/2002 | Comiskey et al. |
| 2002/0090980 | A1 | 7/2002 | Wilcox et al. |
| 2002/0113770 | A1 | 8/2002 | Jacobson et al. |
| 2002/0130832 | A1 | 9/2002 | Baucom et al. |
| 2002/0180687 | A1 | 12/2002 | Webber |
| 2002/0196207 | A1 | 12/2002 | Machida et al. |
| 2002/0196219 | A1 | 12/2002 | Matsunaga et al. |
| 2003/0011560 | A1 | 1/2003 | Albert et al. |
| 2003/0020844 | A1 | 1/2003 | Albert et al. |
| 2003/0025855 | A1* | 2/2003 | Holman et al. ..... 349/86 |
| 2003/0058223 | A1 | 3/2003 | Tracy et al. |
| 2003/0063076 | A1 | 4/2003 | Machida et al. |
| 2003/0102858 | A1 | 6/2003 | Jacobson et al. |
| 2003/0132908 | A1 | 7/2003 | Herb et al. |
| 2003/0137521 | A1 | 7/2003 | Zehner et al. |
| 2003/0151702 | A1 | 8/2003 | Morrison et al. |
| 2003/0214695 | A1 | 11/2003 | Abramson et al. |
| 2003/0222315 | A1 | 12/2003 | Amundson et al. |
| 2004/0012839 | A1 | 1/2004 | Cao et al. |
| 2004/0014265 | A1 | 1/2004 | Kazlas et al. |
| 2004/0027327 | A1 | 2/2004 | LeCain et al. |
| 2004/0051934 | A1 | 3/2004 | Machida et al. |
| 2004/0075634 | A1 | 4/2004 | Gates |
| 2004/0094422 | A1 | 5/2004 | Pullen et al. |
| 2004/0105036 | A1 | 6/2004 | Danner et al. |
| 2004/0112750 | A1 | 6/2004 | Jacobson et al. |
| 2004/0119681 | A1 | 6/2004 | Albert et al. |
| 2004/0120024 | A1 | 6/2004 | Chen et al. |
| 2004/0136048 | A1 | 7/2004 | Arango et al. |
| 2004/0155857 | A1 | 8/2004 | Duthaler et al. |
| 2004/0180476 | A1 | 9/2004 | Kazlas et al. |
| 2004/0190114 | A1 | 9/2004 | Jacobson et al. |
| 2004/0190115 | A1 | 9/2004 | Liang et al. |
| 2004/0196215 | A1 | 10/2004 | Duthaler et al. |
| 2004/0226820 | A1 | 11/2004 | Webber et al. |
| 2004/0233509 | A1 | 11/2004 | Zhang et al. |
| 2004/0239614 | A1 | 12/2004 | Amundson et al. |
| 2004/0246562 | A1 | 12/2004 | Chung et al. |
| 2004/0252360 | A1 | 12/2004 | Webber et al. |
| 2004/0257635 | A1 | 12/2004 | Paolini, Jr. et al. |
| 2004/0263947 | A1 | 12/2004 | Drzaic et al. |
| 2005/0000813 | A1 | 1/2005 | Pullen et al. |
| 2005/0001810 | A1 | 1/2005 | Yakushiji et al. |
| 2005/0001812 | A1 | 1/2005 | Amundson et al. |
| 2005/0007653 | A1 | 1/2005 | Honeyman et al. |
| 2005/0012980 | A1 | 1/2005 | Wilcox et al. |
| 2005/0024353 | A1 | 2/2005 | Amundson et al. |
| 2005/0035941 | A1 | 2/2005 | Albert et al. |
| 2005/0067656 | A1 | 3/2005 | Denis et al. |

FOREIGN PATENT DOCUMENTS

| | | |
|---|---|---|
| EP | 1 145 072 B1 | 5/2003 |
| EP | 1 500 971 A1 | 1/2005 |
| EP | 1 536 271 | 6/2005 |
| JP | 03-091722 A | 4/1991 |
| JP | 03-096925 A | 4/1991 |
| JP | 05-173194 A | 7/1993 |
| JP | 06-233131 A | 8/1994 |
| JP | 09-016116 A | 1/1997 |
| JP | 09-185087 A | 7/1997 |
| JP | 09-230391 A | 9/1997 |
| JP | 11-113019 A | 4/1999 |
| JP | 2000-221546 | 8/2000 |
| WO | WO 99/10870 | 3/1999 |
| WO | WO 00/05704 | 2/2000 |
| WO | WO 00/36560 | 6/2000 |
| WO | WO 00/38000 | 6/2000 |
| WO | WO 00/67110 | 11/2000 |
| WO | WO 00/67327 | 11/2000 |
| WO | WO 01/07961 | 2/2001 |
| WO | WO 03/107315 | 12/2003 |
| WO | WO 2004/001498 | 12/2003 |
| WO | WO 2004/006006 | 1/2004 |
| WO | WO 2004/008239 | 1/2004 |
| WO | WO 2004/055586 | 7/2004 |
| WO | WO 2004/059379 | 7/2004 |

OTHER PUBLICATIONS

Antia, M., "Switchable Reflections Make Electronic Ink", Science, 285, 658 (1999).

Bach, U., et al., "Nanomaterials-Based Electrochromics for Paper-Quality Displays", Adv. Mater, 14(11), 845 (2002).

Chen, Y., et al., "A Conformable Electronic Ink Display using a Foil-Based a-Si TFT Array", SID 01 Digest, 157 (Jun. 2001).

Comiskey, B., et al., "An electrophoretic ink for all-printed reflective electronic displays", Nature, 394, 253 (1998).

Comiskey, B., et al., "Electrophoretic Ink: A Printable Display Material", SID 97 Digest (1997), p. 75.

Drzaic, P., et al., "A Printed and Rollable Bistable Electronic Display", SID 98 Digest (1998), p. 1131.

Duthaler, G., et al., "Active-Matrix Color Displays Using Electrophoretic Ink and Color Filters", SID 02 Digest, 1374 (2002).

Hayes, R.A., et al., "Video-Speed Electronic Paper Based on Electrowetting", Nature, vol. 425, Sep. 25, pp. 383-385 (2003).

Hunt, R.W.G., "Measuring Color", 3d. Edn, Fountain Press (ISBN 0 86343 387 1), p. 63 (1998).

Jacobson, J., et al., "The last book", IBM Systems J., 36, 457 (1997).

Jo, G-R, et al., "Toner Display Based on Particle Movements", Chem. Mater, 14 664 (2002).

Kazlas, P., et al., "12.1 SVGA Microencapsulated Electrophoretic Active Matrix Display for Information Appliances", SID 01 Digest, 152 (Jun. 2001).

Kitamura, T., et al., "Electrical toner movement for electronic paper-like display", Asia Display/IDW'01, p. 1517, Paper HCS1-1 (2001).

Mossman, M.A., et al., "A New Reflective Color Display Technique Based on Total Internal Reflection and Substractive Color Filtering", SID 01 Digest, 1054 (2001).

O'Regan, B. et al., "A Low Cost, High-efficiency Solar Cell Based on Dye-sensitized colloidal TiO2 Films", Nature, vol. 353, Oct. 24, 1991, 773-740.

Pitt, M.G., et al., "Power Consumption of Microencapsulated Electrophoretic Displays for Smart Handheld Applications", SID 02 Digest, 1378 (2002).

Poor, A., "Feed forward makes LCDs Faster", available at "http://www.extremetech.com/article2/0,3973,10085,00.asp".

Shiffman, R.R., et al., "An Electrophoretic Image Display with Internal NMOS Address Logic and Display Drivers," Proceedings of the SID, 1984, vol. 25, 105 (1984).

Singer, B., et al., "An X-Y Addressable Electrophoretic Dispaly," Proceedings of the SID, 18, 255 (1977).

Webber, R., "Image Stability in Active-Matrix Microencapsulated Electrophoretic Displays", SID 02 Digest, 126 (2002).

Wood, D., "An Electrochromic Renaissance?" Information Display, 18(3), 24 (Mar. 2002).

Yamaguchi, Y., et al., "Toner display using insulative particles charged triboelectrically", Asia Display/IDW '01, p. 1729, Paper AMD4-4 (2001).

* cited by examiner

METHOD FOR CONTROLLING ELECTRO-OPTIC DISPLAY

REFERENCE TO RELATED APPLICATIONS

This application claims benefit of Provisional Applications Ser. Nos. 60/481,258 and 60/481,262, both filed Aug. 19, 2003.

This application is also related to (1) copending application Ser. No. 10/065,795, filed Nov. 20, 2002 (Publication No. 2003/0137521), which is itself is a continuation-in-part of application Ser. No. 09/561,424, filed Apr. 28, 2000 (now U.S. Pat. No. 6,531,997), which is itself a continuation-in-part of application Ser. No. 09/520,743, filed Mar. 8, 2000 (now U.S. Pat. No. 6,504,524). application Ser. No. 10/065,795 also claims priority from the following Provisional Applications: (a) Ser. No. 60/319,007, filed Nov. 20, 2001; (b) Ser. No. 60/319,010, filed Nov. 21, 2001; (c) Ser. No. 60/319,034, filed Dec. 18, 2001; (d) Ser. No. 60/319,031, filed Dec. 20, 2001; and (e) Ser. No. 60/319,040, filed Dec. 21, 2001; (2) application Ser. No. 10/249,973, filed May 23, 2003, which is a continuation-in-part of the aforementioned application Ser. No. 10/065,795. application Ser. No. 10/249,973 claims priority from Provisional Applications Ser. No. 60/319,315 filed Jun. 13, 2002 and Ser. No. 60/319,321 filed Jun. 18, 2002; (3) copending application Ser. No. 10/063,236, filed Apr. 2, 2002 (Publication No. 2002/0180687) (4) Application Ser. No. 60/320,207, filed May 20, 2003; (5) Application Ser. No. 60/481,040, filed Jun. 30, 2003; (6) application Ser. No. 10/249,128, filed Mar. 18, 2003 (Publication No. 2003/0214695); (7) Application Ser. No. 60/320,070, filed Mar. 31, 2003; (8) applications Ser. Nos. 10/249,618 (Publication No. 2003/0222315) and 10/249,624 (Publication No. 2004/0014265), both filed Apr. 24, 2003; (9) Application Ser. No. 60/320,207, filed May 20, 2003; and (10) Application Ser. No. 60/48 1,053, filed Jul. 2, 2003.

The entire contents of these copending applications, and of all other U.S. patents and published and applications mentioned below, are herein incorporated by reference.

BACKGROUND OF INVENTION

This invention relates to methods for controlling electro-optic displays. In one aspect this invention relates to providing a reduced power state in an electro-optic display, and more specifically to an active matrix electro-optic display using a bistable electro-optic medium, the display being provided with means for controlling the potential at a common electrode during a non-writing state of the display. In another aspect, this invention relates to methods for controlling electrode voltage in electro-optic displays, and more specifically to methods for controlling the voltage applied to the common front electrode of an active matrix electro-optic display using a bistable electro-optic medium.

Electro-optic displays comprise a layer of electro-optic material, a term which is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The terms "bistable" and "bistability" are used herein in their conventional meaning in the imaging art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in published U.S. patent application No. 2002/0180687 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed to applying an electric field thereto, thus rotating the bodies to various positions and varying which of the sections of the bodies is seen through a viewing surface.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. No. 6,301,038, International Application Publication No. WO 01/27690, and in U.S. patent application No. 2003/0214695. This type of medium is also typically bistable.

Another type of electro-optic display, which has been the subject of intense research and development for a number of years, is the particle-based electrophoretic display, in which a plurality of charged particles move through a suspending fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

Numerous patents and applications assigned to or in the names of the Massachusetts Institute of Technology (MIT) and E Ink Corporation have recently been published describing encapsulated electrophoretic media. Such encapsulated media comprise numerous small capsules, each of which itself comprises an internal phase containing electrophoretically-mobile particles suspended in a liquid suspending medium, and a capsule wall surrounding the internal phase. Typically, the capsules are themselves held within a polymeric binder to form a coherent layer positioned between two electrodes. Encapsulated media of this type are described, for example, in U.S. Pat. Nos. 5,930,026; 5,961,804; 6,017,584; 6,067,185; 6,118,426; 6,120,588; 6,120,839; 6,124,851; 6,130,773; 6,130,774; 6,172,798; 6,177,921; 6,232,950; 6,249,271; 6,252,564; 6,262,706; 6,262,833; 6,300,932; 6,312,304; 6,312,971; 6,323,989; 6,327,072; 6,376,828; 6,377,387; 6,392,785; 6,392,786; 6,413,790; 6,422,687; 6,445,374; 6,445,489; 6,459,418; 6,473,072; 6,480,182; 6,498,114; 6,504,524; 6,506,438; 6,512,354; 6,515,649; 6,518,949; 6,521,489; 6,531,997; 6,535,197; 6,538,801; 6,545,291; 6,580,545; 6,639,578; 6,652,075; 6,657,772; 6,664,944; 6,680,725; 6,683,333; 6,704,133; 6,710,540; 6,721,083; 6,724,519; 6,727,881; 6,750,473; and 6,753,999; and U.S. Patent Applications Publication Nos. 2002/0019081; 2002/0021270; 2002/0053900; 2002/0060321; 2002/0063661; 2002/0063677; 2002/0090980; 2002/0 106847; 2002/0113770; 2002/0130832; 2002/0131147; 2002/0145792; 2002/0171910; 2002/0180687; 2002/0180688; 2002/0185378; 2003/0011560; 2003/0020844; 2003/0025855; 2003/0034949; 2003/0038755; 2003/0053189; 2003/0102858; 2003/0132908; 2003/0137521; 2003/0137717; 2003/0151702; 2003/0189749; 2003/0214695; 2003/0214697; 2003/0222315; 2004/0008398; 2004/0012839; 2004/0014265; 2004/0027327; 2004/0075634; 2004/0094422; 2004/0105036; and 2004/0112750; and International Applications Publication Nos. WO 99/67678; WO 00/05704; WO 00/38000; WO 00/38001; WO 00/36560; WO 00/67110; WO 00/67327; WO 01/07961; WO 01/08241; WO 03/092077; WO 03/107315; and WO 2004/049045.

Many of the aforementioned patents and applications recognize that the walls surrounding the discrete microcapsules in an encapsulated electrophoretic medium could be replaced by a continuous phase, thus producing a so-called "polymer-dispersed electrophoretic display" in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned 2002/0131147. Accordingly, for purposes of the present application, such polymer-dispersed electrophoretic media are regarded as sub-species of encapsulated electrophoretic media.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; and other similar techniques.) Thus, the resulting display can be flexible. Further, because the display medium can be printed (using a variety of methods), the display itself can be made inexpensively.

Certain of the aforementioned E Ink and MIT patents and applications describe electrophoretic media which have more than two types of electrophoretic particles within a single capsule. For present purposes, such multi-particle media are regarded as a sub-class of dual particle media.

A related type of electrophoretic display is a so-called "microcell electrophoretic display". In a microcell electrophoretic display, the charged particles and the suspending fluid are not encapsulated within capsules but instead are retained within a plurality of cavities formed within a carrier medium, typically a polymeric film. See, for example, International Application Publication No. WO 02/01281, and U.S. Patent Application Publication No. 2002/0075556, both assigned to Sipix Imaging, Inc.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, the aforementioned U.S. Pat. Nos. 6,130,774 and 6,172,798, and U.S. Pat. Nos. 5,872,552; 6,144,361; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode.

To obtain a high-resolution electro-optic display, individual pixels of the display must be capable of being addressed without interference from adjacent pixels. One way to achieve this objective is to provide an array of non-linear elements, which may be transistors or diodes, with at least one non-linear element being associated with each pixel of the display. A pixel or addressing electrode adjacent the relevant pixel is connected via the non-linear element to drive circuitry used to control the operation of the display. Displays provided with such non-linear elements are known as "active matrix" displays.

Typically, such active matrix displays use a two-dimensional ("XY") addressing scheme with a plurality of data lines and a plurality of select lines, each pixel being defined uniquely by the intersection of one data line and one select line. One row (it is here assumed that the select lines define the rows of the matrix and the data lines define the columns, but obviously this is arbitrary, and the assignments could be reversed if desired) of pixels is selected by applying a voltage to a specific select line, and the voltages on the data or column lines are adjusted to provide the desired optical response from the pixels in the selected row. The pixel electrodes in the selected row are thus raised to voltages which is close to but (for reasons explained below) not exactly equal to the voltages on their associated data lines. The next row of pixels is then selected by applying a voltage to the next select line, so that the entire display is written on a row-by-row basis.

When the non-linear elements are transistors (typically thin film transistors (TFT's)), it is conventional practice to place the data and select lines, and the transistors, on one side of the electro-optic medium, and to place a single common electrode, which extends across numerous pixels, and typically the whole display, on the opposed side of the electro-optic medium. See, for example, the aforementioned WO 00/67327, which describes such a structure in which data lines are connected to the source electrodes of an array of TFT's, pixel electrodes are connected to the drain electrodes of the TFT's, select lines are connected to the gate electrodes of the TFT's, and a single common electrode is provided on the opposed side of the electro-optic medium. The common electrode is normally provided on the viewing surface of the display (i.e., the surface of the display which is seen by an observer). During writing of the display, the common electrode is held at a fixed voltage, known as the "common electrode voltage" or "common plane voltage" and usually abbreviated "$V_{COM}$". This common plane voltage may have any convenient value, since it is only the differences between the common plane voltage and the voltages applied to the various pixel electrodes which affects the optical states of the various pixels of the electro-optic medium. Most types of electro-optic media are sensitive to the polarity as well as the magnitude of the applied field, and thus is necessary to be able to drive the pixel electrodes at voltages both above and below the common plane voltage. For example, the common plane voltage could be 0, with the pixel electrodes varying from −V to +V, where V is any arbitrary maximum voltage. Alternatively, it is common practice to hold the common plane voltage at +V/2 and have the pixel electrodes vary from 0 to +V.

One important application of bistable electro-optic media is in portable electronic devices, such as personal digital assistants (PDA's) and cellular telephones, where battery life is an important consideration, and thus it is desirable to reduce the power consumption of the display as far as possible. Liquid crystal displays are not bistable, and hence an image written on such a display must be constantly refreshed if the image is to remain visible. The power consumed during such constant refreshment of an image is a major drain on the battery. In contrast, a bistable electro-optic display need only be written once, and thereafter the bistable medium will maintain the image for a substantial period without any refreshing, thus greatly reducing the power consumption of the display. For example, particle-based electrophoretic displays have been demonstrated in which an image persists for hours, or even days.

Thus, it is advantageous to stop scanning an active matrix bistable electro-optic display between image updates to save power. In some cases even more power can be saved by fully powering down the drivers and common plane circuits used to drive the display.

However, implementation of the necessary non-writing mode (alternatively referred to as the "non-scanning" or "zero power" mode) is not trivial. The display should be designed and operated in such a manner that no significant voltage amplitude transients are experienced by the electro-optic medium as the display switches between its writing (scanning) mode and its non-writing modes.

At first glance, it might appear that simply loading the column drivers with the midpoint voltage (i.e., the voltage which is the mid-point of the range used by these drivers), and stopping the gate driver clock with no gate lines selected would be an acceptable way to implement the non-writing mode. However, in practice this would lead to a steady state DC bias current being applied to the electro-optic medium. Any active matrix display suffers from an effect called "gate feedthrough" or "kickback", in which the voltage that reaches a pixel electrode is shifted by some amount (usually 0.5–2.0V) from the corresponding column (data) voltage input. This gate feedthrough effect arises from the scanning of the gate (select) lines acting through the coupled electrical network between gate lines and source lines/pixel electrodes. Thus, the voltages actually applied to the pixel electrodes are shifted negatively from the column driver voltages because of the gate feedthrough during scanning. Normally, the common plane voltage is offset negatively from its notional value by a fixed amount to allow for this gate feedthrough shift in the voltages applied to the pixel electrodes. When scanning is stopped, this shift due to gate feedthrough will not occur and the column driver mid-point voltage will then be higher than that required to generate zero voltage difference between the common plane and pixel electrodes. The TFT's will accordingly leak current between the column lines and the pixel electrodes under this bias according to their off state characteristics, and this current will flow from the pixel electrodes through the electro-optic medium to the common electrode. This current flow will in turn generate a voltage across the electro-optic medium, and this voltage is undesirable because such it can disturb the optical state of the electro-optic medium during the non-writing period and can also lead to reduced material lifetime and the buildup of charges in the electro-optic medium that will adversely affect the optical states of subsequent images after scanning is resumed. (It has been shown that at least some electro-optic media are adversely affected if the current therethrough is not DC balanced over the long term, and that such DC imbalance may lead to reduced working lifetime and other undesirable effects.)

Furthermore, although at first glance it might appear that powering down the driver circuitry in preparation for a non-writing mode only requires that the circuitry supplying biasing voltages be shut down, or that the flow of power from such circuitry to the drivers be interrupted, in practice either measure is likely to provide undesirable voltage transients to the electro-optic medium; such voltage transients may be caused by, inter alia, parasitic capacitances present in conventional active matrix driver circuitry.

In one aspect, the present invention seeks to provide apparatus for, and methods, of implementing, a non-writing mode in an electro-optic display without imposing undesirable voltage transients on the electro-optic medium during switching of the display into and out of the non-writing mode. The present invention also seeks to provide apparatus for, and methods, of implementing a non-writing mode in an electro-optic display without undesirable voltage offsets on the electro-optic medium that could adversely affect this medium.

Other aspects of the present invention relate to methods for measuring and correcting voltage offsets. The origin of gate feedthrough voltage has been explained above. Ideally, the gate feedthrough voltage is roughly equal across all the pixels in an array and can be cancelled out by applying an offset to the common electrode voltage. However, it is difficult to apply to the common electrode an offset voltage that almost exactly cancels out the feedthrough voltage. In order to do so, means must be provided to ascertain whether the offset voltage accurately matches the feedthrough voltage, and to generate, set and adjust the offset voltage. Ideally, the feedthrough voltage would be known beforehand and the offset voltage could be set permanently and cheaply at the time the display electronics are manufactured. In practice, some adjustment of offset voltage is required after the electronics and the display are assembled as a final unit.

In conventional liquid crystal displays (LCD's), adjustment of the offset voltage can be effected by eye; when an incorrect offset voltage is applied, the eye will detect a flickering of the display. The offset voltage can then by adjusted by an operator varying an analog potentiometer until the flicker disappears.

However, in particle-based electrophoretic displays, and in most other types of bistable electro-optic displays, an incorrect offset voltage will not cause any effects visible to the human eye unless the error in the offset voltage is very large. Thus, substantial errors in offset voltage can persist without being observable visually, and these substantial errors can have deleterious effects on the display if left uncorrected. Accordingly, it is highly desirable to provide some method other than visual observation to detect errors in the offset voltage. Furthermore, although such errors, once detected and measured, can be corrected manually in the same way as in LCD's, such manual correction is inconvenient and it is desirable to provide some way of adjusting the offset voltage automatically.

The present invention seeks to provide apparatus for, and methods of, measuring and correcting offset voltage. The present invention extends to both manual and automatic correction methods.

SUMMARY OF INVENTION

Accordingly, in one aspect, this invention provides an electro-optic display comprising:

a layer of a bistable electro-optic medium;

a plurality of pixel electrodes disposed on one side of the layer of electro-optic medium, at least one non-linear element associated with each pixel electrode;

pixel drive means arranged to apply voltages to the pixel electrodes via the non-linear elements;

a common electrode on the opposed side of the layer of electro-optic medium from the pixel electrodes; and common electrode control means arranged to apply voltages to the common electrode, the display having a writing mode, in which the pixel drive means applies at least two different voltages to different ones of the pixel electrodes, thereby writing an image on the electro-optic medium, and a non-writing mode in which the pixel drive means controls the voltages applied to the pixel electrodes so that any image previously written on the electro-optic medium is substantially maintained, the common electrode control means being arranged to apply to the common electrode a first voltage when the display is in its writing mode and a second voltage, different from the first voltage, when the display is in its non-writing mode.

For convenience, the display of the present invention may hereinafter be referred to as a "variable common plane voltage display". There are two principal variants of such a display. In both variants, the common electrode is held at a predetermined voltage during the writing mode. (This does not exclude the possibility that the display might have more than one writing mode with differing voltages being applied to the common electrode in different writing modes. For example, as discussed in the aforementioned 2003/0137521, it may sometimes be desirable to use so-called "top plane switching", in which the common electrode is switched between (say) 0 and +V, while the voltages applied to the pixel electrodes vary from 0 to +V with pixel transitions in one direction being handled when the common electrode is at 0 and transitions in the other direction being handled when the common electrode is at +V. For example if one assumes a black/white display, depending upon the characteristics of the electro-optic medium, white-going transitions (i.e., transitions in which the final state of the pixel is lighter than the initial state) might be handled when the common electrode is at 0 and black-going transitions (i.e., transitions in which the final state of the pixel is darker than the initial state) might be handled when the common electrode is at +V.) However, in the first principal variant, when the display is in its non-writing mode, the voltage on the common electrode is held at a "fixed" value (which may be subject to adjustment in ways to be described below) by connecting the common electrode to a voltage supply line or other circuitry. In the second principal variant, when the display is in its non-writing mode, the common voltage is disconnected from external voltage sources and allowed to "float". When it is necessary to distinguish between these two variants in the discussion below, the former will be referred to as a "dual common plane voltage display", while the latter will be referred to as a "floating common electrode display".

A dual common plane voltage display may comprise:

a first voltage supply line arranged to supply the first voltage;

a second voltage supply line arranged to supply the second voltage;

an output line;

switching means for connecting one of the first and second voltage supply lines to the output line; and a control line connected to the switching means and arranged to receive a control signal having a first or a second value, the switching means being arranged to connect the output line to the first voltage supply line when the control signal has the first value and to connect the output line to the second voltage supply line when the control signal has the second value.

In this form of the dual common plane voltage display, the output line may be connected to the common electrode. In this case, the display may further comprise at least one sensor pixel having an associated sensor pixel electrode arranged to receive the second voltage, the at least one sensor pixel being connected to the second voltage supply line. The display may further comprise a differential amplifier having its positive input connected to the at least one sensor pixel, and its output connected to both its negative input and the second voltage supply line.

Alternatively, the output line may be arranged to control the mid-point of the voltage range of the pixel drive means. If, as described in the aforementioned WO 00/67327, a capacitor is associated with each pixel electrode, one electrode of each capacitor may be arranged to receive the same voltage as the common electrode.

A floating common electrode display may comprise:

a voltage supply line arranged to supply the first voltage;

an output line connected to the common electrode;

switching means for connecting the voltage supply line to the output line; or for disconnecting the output line from the voltage supply line;

a control line connected to the switching means and arranged to receive a control signal having a first or a second value, the switching means being arranged to connect the output line to the voltage supply line when the control signal has the first value and to disconnect the output line from the voltage supply line when the control signal has the second value.

The dual common plane voltage display of the present invention will typically comprise bias supply circuitry arranged to supply the first and second voltages, and the display may be provided with means for shutting down the bias supply circuitry when the display is in its non-writing mode. The pixel electrodes may be arranged to receive the same voltage as the common electrode during shut down and powering up of the bias supply circuitry.

The variable common plane voltage display of the present invention may make use of any of the types of electro-optic medium described above. Thus, in the display, the electro-optic layer may comprises a rotating bichromal member or electrochromic display medium, or a particle-based electrophoretic material comprising a suspending fluid and a plurality of electrically charged particles suspended in the suspending fluid and capable of moving therethrough on application of an electric field to the electrophoretic material. Such an electrophoretic medium may be encapsulated electrophoretic material in which the suspending fluid and the electrically charged particles and encapsulated within a plurality of capsules, each of the capsules having a capsule wall, or may be of the microcell type in which the suspending fluid and the electrically charged particles are retained within a plurality of cells formed in a substrate.

This invention also provides a method of operating an electro-optic display which comprises a layer of a bistable electro-optic medium; a plurality of pixel electrodes disposed on one side of the layer of electro-optic medium, each pixel electrode having at least one non-linear element associated therewith; and a common electrode on the opposed side of the layer of electro-optic medium from the pixel electrodes. The method comprises:

applying a first voltage to the common electrode while applying at least two different voltages to different ones of the pixel electrodes, thereby writing an image on the electro-optic medium; and applying a second voltage, different from the first voltage, to the common electrode while controlling the voltages applied to the pixel electrodes so that any image previously written on the electro-optic medium is substantially maintained.

This invention also provides a method of operating an electro-optic display which comprises a layer of a bistable electro-optic medium; a plurality of pixel electrodes disposed on one side of the layer of electro-optic medium, each pixel electrode having at least one non-linear element associated therewith; a common electrode on the opposed side of the layer of electro-optic medium from the pixel electrodes, and a voltage supply line for supplying voltage to the common electrode. This method comprises:

applying a first voltage to the common electrode while applying at least two different voltages to different ones of the pixel electrodes, thereby writing an image on the electro-optic medium; and controlling the voltages applied to the pixel electrodes so that any image previously written on the electro-optic medium is substantially maintained, while disconnecting the common electrode from the voltage supply line, thereby allowing the voltage on the common electrode to float.

As already mentioned, other aspects of the present invention relate to apparatus and methods for measuring and correcting offset voltage. Thus, in another aspect this invention provides an electro-optic display comprising:

a layer of a bistable electro-optic medium;

a plurality of pixel electrodes disposed on one side of the layer of electro-optic medium, at least one of the pixel electrodes being a sensor pixel electrode;

at least one non-linear element associated with each pixel electrode;

pixel drive means arranged to apply voltages to the pixel electrodes via the non-linear elements, the pixel drive means being arranged to apply a predetermined voltage to the at least one sensor pixel electrode;

a common electrode on the opposed side of the layer of electro-optic medium from the pixel electrodes; and measuring means arranged to receive the predetermined voltage and the voltage on the at least one sensor pixel and to determine the difference therebetween.

This invention also provides an electro-optic display comprising:

a layer of a bistable electro-optic medium;

a plurality of pixel electrodes disposed on one side of the layer of electro-optic medium;

at least one non-linear element associated with each pixel electrode;

pixel drive means arranged to apply voltages to the pixel electrodes via the non-linear elements;

a common electrode on the opposed side of the layer of electro-optic medium from the pixel electrodes;

a common electrode voltage supply line arranged to supply at least one voltage;

switching means connecting the voltage supply line to the common electrode, the switching means having an operating condition in which the voltage supply line is connected to the common electrode, and a testing condition in which the voltage supply is disconnected from the common electrode, thereby allowing the voltage on the common electrode to float, the pixel drive means being arranged to supply a single predetermined voltage via the non-linear elements to all the pixel electrodes when the switching means is in its testing condition, the display further comprising measuring means arranged to receive the single predetermined voltage and the voltage on the common electrode when the switching means is in its testing condition and to determine the difference therebetween.

This invention also provides an electro-optic display comprising:

a layer of a bistable electro-optic medium;

a plurality of pixel electrodes disposed on one side of the layer of electro-optic medium, at least one of the pixel electrodes being a sensor pixel electrode;

at least one non-linear element associated with each pixel electrode;

pixel drive means arranged to apply voltages to the pixel electrodes via the non-linear elements, the pixel drive means being arranged to apply a predetermined voltage to the at least one sensor pixel electrode;

a common electrode on the opposed side of the layer of electro-optic medium from the pixel electrodes; and common electrode voltage control means arranged to receive a signal representative of the voltage on the at least one sensor pixel electrode and to vary the voltage applied to the common electrode in dependence upon said signal.

Finally, this invention provides a method of operating an electro-optic display comprising a layer of a bistable electro-optic medium; a plurality of pixel electrodes disposed on one side of the layer of electro-optic medium; at least one non-linear element associated with each pixel electrode; pixel drive means arranged to apply voltages to the pixel electrodes via the non-linear elements; a common electrode on the opposed side of the layer of electro-optic medium from the pixel electrodes. The method comprises:

applying by means of the pixel drive means a predetermined voltage to all the pixel electrodes of the display;

storing a value representative of the difference between the predetermined voltage and the voltage appearing on the common electrode during application of the predetermined voltage to the pixel electrodes; and thereafter applying to the common electrode a voltage dependent upon the stored value, while applying the pixel electrodes voltages which cause an image to be written upon the electro-optic medium.

DETAILED DESCRIPTION

As already indicated, the present invention has several different aspects relating displays and methods for controlling electrode voltage in electro-optic displays, and to measuring and correcting for feedthrough voltage in such displays. The various aspects of the invention will generally be described separately below, but it will be appreciated that a single display may make use of more than one aspect of the present invention; for example, the display of FIG. 6 makes use of both the floating common electrode display and feedthrough voltage measuring aspects of the invention.

As discussed above, the main problem with which the present invention seeks to deal is the difference caused by gate feedthrough between the voltages which the driver circuits apply to the non-linear elements of an electro-optic display (these may hereinafter be called "column driver voltages" since as already indicated it is conventional though essentially arbitrary to select one row of pixels of an active matrix display for writing at any one time, and then to apply to the column (data) electrodes the various voltages required to produce on the pixel electrodes the various voltages (these may hereinafter be called "pixel electrode voltages") needed to produce the desired transitions in the pixels of the selected row.

Figure 1:
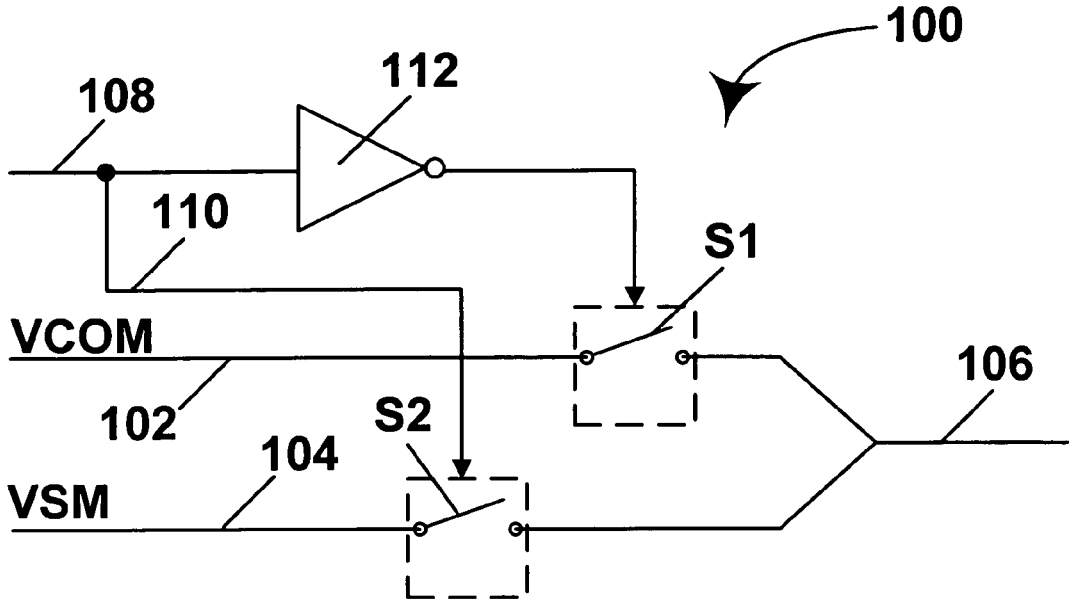
FIG. 1 is a partial circuit diagram of a dual common plane voltage display of the present invention.

FIG. 1 is a partial circuit diagram of a preferred dual common plane voltage display of the present invention and illustrates the common electrode control means (generally designated 100). This control means 100 comprises a first voltage supply line 102, a second voltage supply line 104 and an output line 106. The control means 100 further comprises switching means in the form of a first switch S1 interposed between the first voltage supply line 102 and the output line 106, and a second switch S2 interposed between the second voltage supply line 102 and the output line 106. As indicated in FIG. 1, the switches S1 and S2 are connected to a control line 108, the switch S2 being connected directly to control line 108 via a line 110, while the switch S1 is connected to control line 108 via an inverter 112. The output line 106 is connected to the common electrode (not shown) of a bistable electro-optic display.

The voltage supply lines 102 and 104 are both connected to bias supply circuitry (not shown, but of a conventional type which will be familiar to those skilled in the technology of active matrix displays). The bias supply circuitry provides on line 102 a voltage $V_{COM}$, which is the correct voltage for the common electrode during the writing (scanning) mode of the display, and is essentially the midpoint of the range of pixel electrode voltages. Also, the bias supply circuitry provides on line 104 a voltage $V_{SM}$, which is the correct voltage for the common electrode during a non-writing mode of the display, and is essentially set to the midpoint of the range of column driver voltages. Thus, $V_{COM}$ and $V_{SM}$ differ by an amount equal to the gate feed voltage of the display.

The control line 108 receives a single two-state control signal from control circuitry (not shown), this control signal having a first, low or writing value while the display is being written and a second, high or non-writing value when the display is not being written. When the display is in its writing mode (i.e., the image is being updated), the control signal on line 108 is held low, so that switch S1 is closed, switch s2 is open and the output line 106 and the common electrode are connected directly to the first voltage supply line 102 and receive voltage $V_{COM}$. On the other hand, when the display is in its non-writing mode (i.e., the image is not being updated), the control signal on line 108 is held high, so that switch S1 is open, switch S2 is closed and the output line 106 and common electrode are connected directly to the second voltage supply line 104 and receive voltage $V_{SM}$. During this non-writing mode, the column drivers would also set all of the pixel electrodes to voltage $V_{SM}$, thus creating zero voltage between the pixel electrodes and the common electrode.

As already noted, the output line 106 of the circuit of FIG. 1 is connected to the common electrode of the associated display. However, the output line 106 may alternatively be connected to circuitry used to control the midpoint of the voltage range used by the column drivers. When the output line is connected in this alternative manner, the control signals should be inverted from those described above with reference to FIG. 1, so that the output line 106 receives voltage $V_{SM}$ when the display is in its writing mode voltage and $V_{COM}$ when the display is in its non-writing mode. (Alternatively, of course, the same result could be achieved by keeping the same control signals and reversing the connections from the control line 108 to switches S1 and S2, so that S1 is connected directly to line 108 and S2 is connected to line 108 via the inverter 112.) In this case, the common electrode would receive $V_{COM}$ at all times.

Regardless of whether output line 106 is connected to the common electrode or to circuitry used to control the midpoint of the voltage range used by the column drivers, if the pixel electrodes are provided with associated storage capacitors, as described for example in the aforementioned WO 00/67327, it is desirable to feed to the counter electrodes of the pixel capacitors (i.e., the capacitor electrodes which are not at the same voltages as their associated pixel electrodes) the same voltage as is fed to the common electrode.

The circuit shown in FIG. 1, with its output line 106 connected to the common electrode of the display, may cause the electro-optic medium to experience some small, undesirable voltage transients during transitions between the writing and non-writing modes of the display. For example, in a preferred method of operation, on the last scan before the display is shifted into its non-writing mode, all the column drivers are set to voltage $V_{SM}$. For the reasons previously explained, the actual pixel voltage will differ slightly from $V_{SM}$ because of at this point the display is still subject to gate feedthrough, and the pixel voltage will in fact be equal to $V_{COM}$, the same voltage as is applied to the common electrode during this scan. If the common electrode is then immediately switched to voltage $V_{SM}$ by the circuit 100, the electro-optic medium will experience a transient equal to the gate feedthrough voltage present on the pixel electrodes, this transient gradually decaying as the pixel electrodes charge up to voltage $V_{SM}$ by leakage through the pixel transistors and the electro-optic medium. Obviously, it is desirable to eliminate this voltage transient, or reduce it as far as possible. Similarly, a small voltage transient will be generated as the display is switched from its non-writing to its writing mode. When the circuit shown in FIG. 1 is used to control the mid-point of the voltage range used by the column drivers, no voltage transient is generated as the display is switched from its writing to its non-writing mode, or vice versa.

Figure 2:
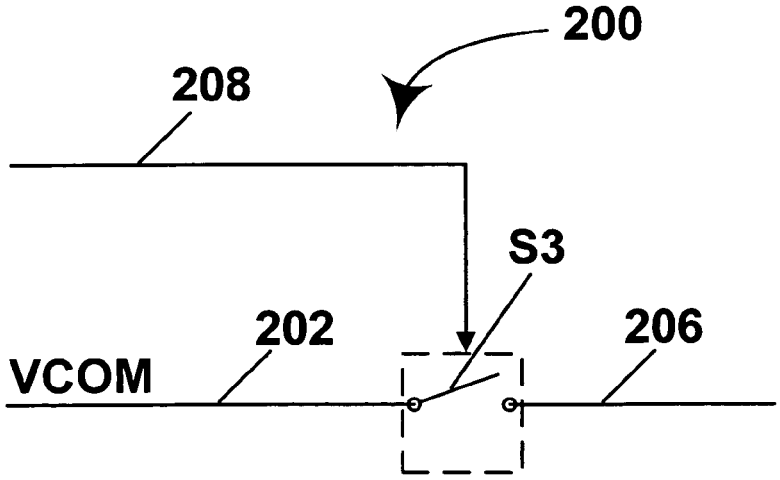
FIG. 2 is a partial circuit diagram of a floating common electrode display of the present invention.

FIG. 2 is a partial circuit diagram of a preferred floating common electrode display of the present invention and illustrates the common electrode control means (generally designated 200). This control means 200 is generally similar to the control means 100 shown in FIG. 1 and comprises a voltage supply line 202, supplied with voltage $V_{COM}$ by bias control circuitry (not shown), an output line 206 connected to the common electrode (not shown) of the display, a switch S3 connecting these two lines and a control line 208 which controls the operation of the switch S3. Since the inverter 112 present in the control means 100 is omitted from the control means 200 of FIG. 2, the control signals on line 208 need to be inverted from those on line 108, so that during the writing mode of the display switch S3 is closed and the common electrode receives $V_{COM}$ from voltage supply line 202 via switch S3 and output line 206.

When the display is in its non-writing mode, the switch S3 is open and the common electrode is disconnected from the bias supply circuitry and allowed to "float". During such floating of the common electrode, with all the column electrodes held at $V_{SM}$ as already described, current leakage through the pixel transistors and through the electro-optic medium will eventually charge both the pixel electrodes and the common electrode up to the voltage VSM, thus leaving zero field across the electro-optic medium. It will be seen that, like the drive means 100, the drive means 200 shown in FIG. 2 will also generate a small voltage transient as the display is switched between its writing and non-writing modes, this transient persisting until the voltages on the pixel electrodes and the common electrode have been equalized or reset in the manner already described.

Figure 3:
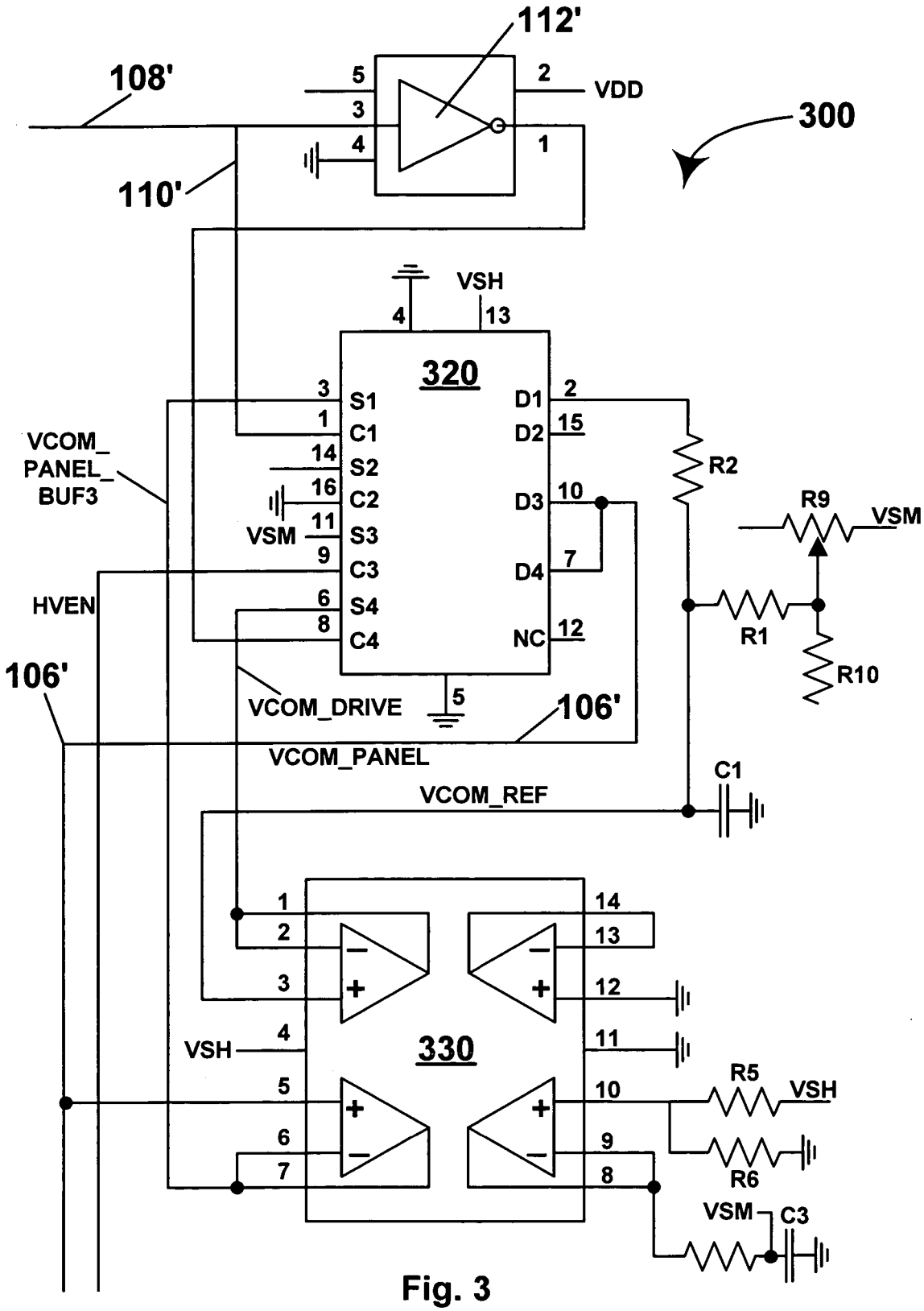
FIG. 3 is a partial circuit diagram of a prototype circuit for implementing the basic circuitry of FIG. 1, and certain other aspects of the invention, in a large active matrix display.

FIG. 3 is a partial circuit diagram of a prototype circuit (generally designated 300) for implementing the basic circuitry of FIG. 1, and certain other aspects of the invention, in a large active matrix display. At this point, only those parts of FIG. 3 similar to the circuitry of FIG. 1 will be described, with remaining portions of FIG. 3 being described below with reference to the aspects of the present invention which they embody.

The circuit 300 comprises a control line 108' and a line 110' which are exactly analogous to the corresponding lines in FIG. 1. The circuit 300 also comprises an inverter 112', analogous to the inverter 112 in FIG. 1, but provided by an NC7SZ04M5 integrated circuit (IC). The inverted output on pin 1 of this IC is fed to pin 8 (C4) of an IC 320, which is a quad switch of the DG201B type. Line 110' is connected to pin 1 (C1) of the same chip. The S4/D4/C4 (pins 6, 7 and 8) section of the IC 320 corresponds to switch S1 in FIG. 1 and pin 7 (D4) of IC 320 is connected to an output line 106', which is in turn connected to the common electrode of the display.

FIG. 3 also illustrates part of the bias control circuitry used to generate the input voltages $V_{COM}$ and $V_{SM}$ used by the common electrode control means of the present invention. As illustrated at the bottom right of FIG. 3, a signal $V_{SH}$, which is the highest voltage used to drive the column drivers, is fed to a voltage divider comprising resistors R5 and R6 of equal resistance, and the voltage between R5 and R6, which is one-half of $V_{SH}$, is fed to pin 10 (a positive input) of an IC 330, which is an OPA4243 quad operational amplifier. The resultant amplifier output on pin 8 of IC 330 is fed back to the negative input on pin 9 thereof, and is also fed to a circuit comprising resistor R4 and capacitor C3, this RC circuit being tapped between resistor R4 and capacitor C3 to provide the voltage $V_{SM}$ used elsewhere in the circuit 300 as described below. Capacitor C3 serves, in the conventional manner, as a reservoir to stabilize the voltage $V_{SM}$.

The voltage $V_{SM}$ thus produced is fed to pin 11 (S3) of IC 320; a high voltage enable (HVEN) signal (used to control powering up or powering down of the driver circuitry) is fed to the corresponding control pin 9 (C3) of IC 320, and the resultant output on pin 10 (D3) is connected to the output line 106'. The voltage $V_{SM}$ is also fed to a variable voltage divider comprising potentiometer R9 and resistor R10, the voltage present between R9 and R10 being fed via a resistor R1 as a signal designated $V_{COM}$_REF to pin 3 (a positive input) of IC 330. The corresponding output on pin 1 of IC 330 is fed back to the negative input on pin 2 thereof, and is also fed as a signal designated $V_{COM}$_DRIVE to pin 6 (S4) of IC 320.

The signal on line 106' (which, as already described, may be either $V_{COM}$ or VSM depending upon the value of the control signal on line 108') is fed to pin 5 (a positive input) of IC 330. The corresponding output on pin 7 of IC 330 is fed back to the negative input on pin 6 thereof, and is also fed as a signal designated $V_{COM}$_PANEL_BUF3, to pin 3 (S1) of IC 320. As already mentioned pin 1 (C1) of IC 320 receives the signal from control line 108' via line 110'. The corresponding output on pin 2 (D1) of IC 320 is fed to a circuit comprising resistor R2 and capacitor C1, the voltage present between resistor R2 and capacitor C1 being fed as the aforementioned signal $V_{COM}$_REF to pin 3 of IC 330. Capacitor C1 serves, in the conventional manner, as a reservoir to stabilize the voltage $V_{COM}$_REF. (The circuit shown in FIG. 3 is intended for experimental purposes rather than mass production, and hence is arranged to be used in varying modes. The circuit is designed so that normally only one of R1 and R2 will be present at any one time. With R2 present and R1 absent, the circuit can function in substantially the same manner as the circuit of FIG. 9 below; when R1 is present and R2 absent, the circuit functions in substantially the same manner as the circuit of FIG. 7 below.)

Figure 4:
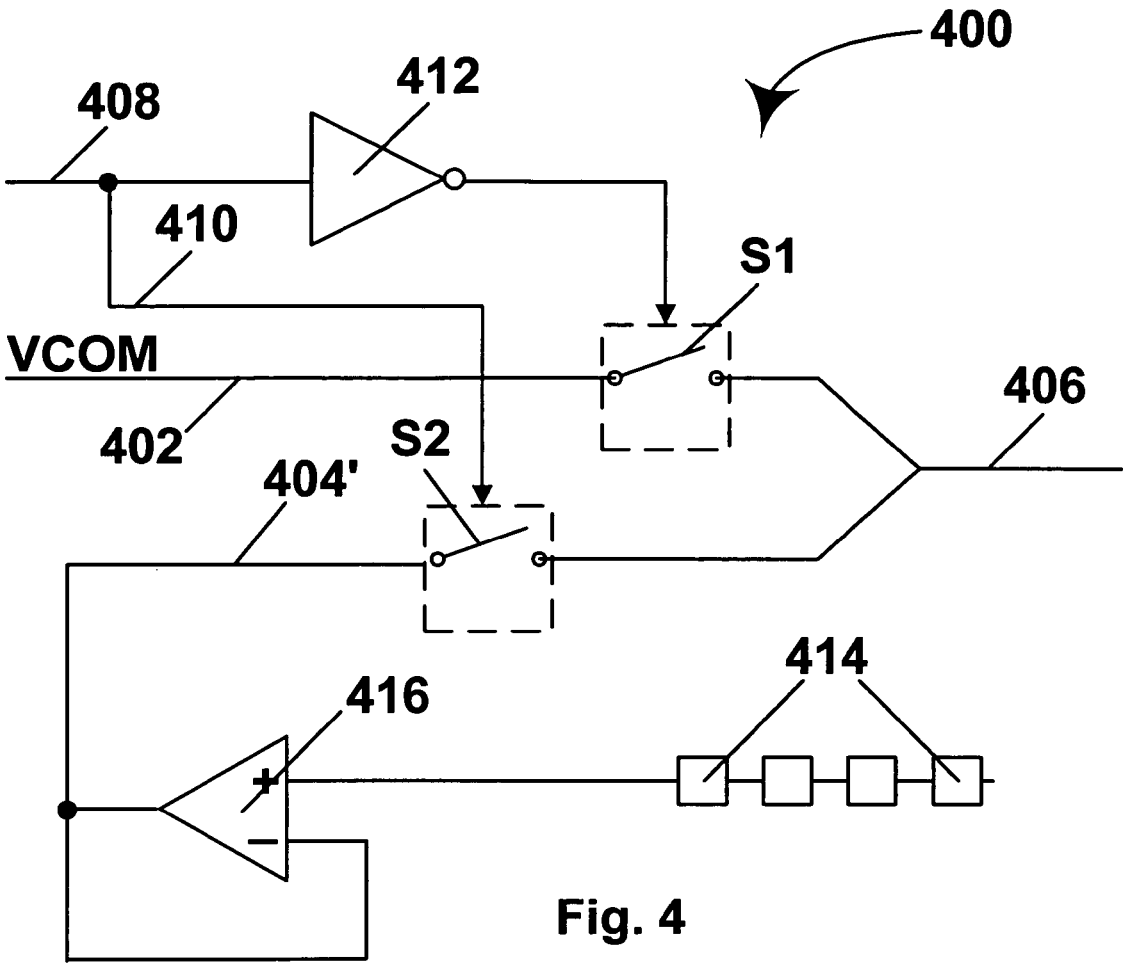
FIG. 4 is a partial circuit diagram of a modified version of the dual common plane voltage display of FIG. 1 which uses sensor pixels.

The common electrode control means (generally designated 400) shown in FIG. 4 of the accompanying drawings is a variant of the control means 100 shown in FIG. 1, but makes use of one or more "sensor" pixels located on the display itself. The control means 400 comprises lines 402, 406, 408 and 410, an inverter 412 and switches S1 and S2, all of which function is essentially the same manner as the corresponding integers in the control means 100 shown in FIG. 1. However, the second voltage input 404' of control means 400 is not simply supplied with a voltage $V_{SM}$ by the bias control circuitry; instead, the voltage on sensor pixels 414 is fed to the positive input of a differential amplifier 416, and the output of this amplifier is fed to both the negative input thereof and to line 404'.

The sensor pixels 414 are conveniently situated on areas of the display, or in rows or columns, that are outside the portion of the display normally seen by a user. For example, the sensor pixels 414 could be provided as an extra row of pixels normally hidden by the bezel of the display. The control circuitry of the display is arranged so that the pixel electrodes of the sensor pixels are constantly written with the voltage $V_{SM}$, which is communicated back to the second voltage supply line 404' as already described.

As will ready be apparent to those skilled in driving electro-optic displays, the control means 400 operates in a manner exactly analogous to the control means 100 shown in FIG. 1. The differential amplifier 416 serves to buffer the voltage from the sensor pixels 414. When the display is in its writing mode, as in the control means 100 shown in FIG. 1, switch S1 is closed and switch S2 open, so that the common electrode receives voltage $V_{COM}$. When the display is to be shifted from its writing to its non-writing mode, at the conclusion of the last scan of the display, the control signal goes high, so that switch S1 is opened and switch S2 closed. At this point, the voltage on the sensor pixels 414 will be equal to $V_{COM}$, so that no voltage transient is generated as the common electrode is connected to the output of amplifier 416. Thereafter, as the pixel electrodes of the display, including the sensor pixels 414, are gradually charged up to voltage $V_{SM}$ by leakage through the pixel transistors in the manner already described, the connection between the sensor pixels 414 and the common electrode ensures that the voltage on the common electrode tracks exactly that present on the pixel electrodes, so that no electric field is present across the electro-optic medium. However, a small voltage transient will be generated as the display is switched from its non-writing to its writing mode.

The control means 400 could be modified so that the common electrode is always connected to the sensor pixels 414, provided that the sensor pixels are arranged so that they are always written with the voltage $V_{SM}$. This arrangement has the added benefit of allowing the common plane voltage to be self-trimming. If only one sensor pixel were used, and the voltage on this pixel were only transmitted to the common electrode when the display was in its non-writing mode (as in the control means 400), the sensor pixel could be a regular pixel of the array (i.e., an image pixel), instead of a dedicated sensor pixel.

The embodiments of the invention shown in FIGS. 1 to 4 rely upon analog circuitry. However, the control of the common plane voltage required by the variable common plane voltage display of the present invention can also be effected digitally. For example, the common electrode could be connected to the output of a digital analog converter (DAC) with this output being controlled by the display controller. In this manner, the common plane voltage could be set to any desired value during both the writing and non-writing modes of the display. However, the hardware required for this digital embodiment will normally be more expensive than that required for the analog embodiments described above, and arranging for the common electrode to follow the ramping down of the driver mid-point voltage during powering down of the driver would be more difficult and error prone.

In other embodiments of the present invention, the common plane voltage, or the voltage applied to the pixel electrodes, during the non-writing mode of the display may be established by software design, thus dispensing with the analog circuitry previously described; instead, the common plane voltage, or the voltage applied to the pixel electrodes, during the non-writing mode is selected to minimize the electric field across the electro-optic medium. Typically, when using modern digital driver circuitry, there is available a digital voltage closer to $V_{COM}$ than $V_{SM}$, especially if the digital resolution of the drivers is high. For example, consider a display in which the column drivers use a range of 0 to 30 volts so that $V_{SM}$ is 15 volts, and assume that $V_{COM}$ is 14 volts (15 volts minus 1 volt caused by gate feedthrough), and the drivers provide six bits of voltage resolution and fully linear voltage control. If the output of the column drivers were left at $V_{SM}$ (15 volts) during the non-writing mode, the electro-optic medium would be subjected to the field resulting from a one volt difference between the pixel electrodes and the common electrode. However, the column drivers are capable of providing a voltage of 14.063 volts (two digital steps down from $V_{SM}$), and if this voltage is applied to the pixel electrodes during the non-writing mode, the electro-optic medium is only subjected to the field resulting from a 63 mV difference between the pixel and common electrodes. Such a greatly reduced field across the electro-optic medium will be acceptable in most cases.

In other words, in many cases a digitally-accessible voltage can be chosen for the column drivers that greatly reduces the electric field across the electro-optic medium during the non-writing mode of the display, by choosing the digitally-accessible voltage that is closest to the common plane voltage in the non-writing mode.

As already indicated, the variable common plane voltage display of the present invention may be provided with means for shutting down the bias supply circuitry during the non-writing mode of the display (cf. the use of signal HVEN in FIG. 3, as described above), thus providing substantial additional power savings. However, if the bias supply circuitry is to be shut down, it is highly desirable to ensure that the common plane voltage does not differ significantly from the voltage on the pixel electrodes during shut down and power up of the bias supply circuitry. This may be achieved by leaving the column drivers driving the pixel electrodes with voltage $V_{SM}$ during shut down and power up of the bias supply circuitry. When this is done, the common electrode should be directly connected to, or arranged to follow, the $V_{SM}$ voltage as this voltage changes. This could be achieved using either of the circuits shown in FIGS. 1 and 2. Using the circuit of FIG. 1, the common electrode could simply be switched to the voltage $V_{SM}$. Using the circuit of FIG. 2, the common electrode would be allowed to float as the voltage $V_{SM}$ varies during power up. Either of these circuits would minimize the voltage transients experienced by the electro-optic medium, but the circuit shown in FIG. 4 would eliminate such transients completely. Use of a DAC to control the common plane voltage may be difficult in such an arrangement.

Once power has been shut off to the bias supply circuitry, power can also be shut off to the logic circuitry, and thereafter power can be cut to the operational amplifiers and analog switches typically used as part of the control circuitry. Achieving the necessary sequence of operations requires that the display electronics include appropriate power sequencing hardware, and that appropriate software be provided in the display controller.

Those skilled in display driver technology will appreciate that, when the display is powered up after the bias supply circuitry and drivers have been powered down, the system requires a significant time (perhaps 10–100 msec) to re-energize before updating of the image on the electro-optic medium can recommence. In some applications (for example, when the display is being used as an information sign at an airport, rail station or similar location), the resultant delay in not objectionable. However, in other applications (for example, when the display is being used as an electronic book), the resultant delay may be objectionable if often repeated. In the latter applications, a reasonable compromise between the responsiveness available from a basic non-writing mode of the display, in which the bias supply circuitry and the drivers are still powered, and the additional power savings available from a "sleep" mode, in which the bias supply circuitry and/or drivers are powered down, is to have the display enter a basic non-writing mode as soon as image updating is no longer required, but to have the display enter the sleep mode only after the basic non-writing mode has persisted for a substantial time. For example, if the display is being used as an electronic book, the delay before entry into sleep mode could be chosen so that the display would not enter sleep mode while the user reads the single page provided by the image (so that updating to the next page would be essentially instantaneous), but the display would enter sleep mode when the user interrupts his reading for several minutes, for example to deal with a telephone call. Alternatively, if the display is under the control of a host system (for example, if the display is being used as an auxiliary screen for a portable computer or cellular telephone), powering down of the bias supply circuitry and drivers might be controlled by the host system; note that in this case the host system needs to allow for the delay in powering up the display before sending a new image to the display.

From the foregoing, it will be seen that preferred embodiments of the variable common plane voltage display of the present invention can provide apparatus and methods for substantially reducing the power consumption of electro-optic displays without affecting images already written on the display, and without exposing the electro-optic medium to voltage transients which may have adverse effects on the medium.

The foregoing discussion has concentrated upon apparatus and methods of the present invention for compensating for the effects of gate feedthrough voltage once that voltage is known. For example, the previous description of the operation of the control means 100 shown in FIG. 1 has assumed that the gate feedthrough voltage (the difference between $V_{COM}$ and $V_{SM}$), and hence the proper value to be assigned to $V_{COM}$, is known, and that appropriate circuitry is available for generating the voltage $V_{COM}$ on the first voltage supply line. Attention will now be directed to methods for measuring the gate feedthrough voltage and for adjusting the display circuitry to ensure that appropriate voltages are available to compensate for the gate feedthrough voltage.

The first challenge is to measure accurately the magnitude of the feedthrough voltage for any specific combination of panel, drivers, scan rate, and other relevant factors. Although this invention does not exclude the use of other approaches, two preferred types of measuring methods are sensor pixels and floating common electrodes.

The sensor pixel approach makes use of one or more sensor pixels on the display, the only purpose of these pixels being to provide an indication of the required feedthrough voltage. For example, as already discussed above with reference to FIG. 4, one or more pixels could be added on the edges of the pixel array beyond the edges of the designed active pixel area (i.e., the area of the display used to show images). These sensor pixels would be identical to active pixels except that a conductive path connects the sensor pixels to a point on the edge of the panel where an interconnect to a measurement system is made. All the sensor pixels on the panel could be wired together, and during panel scanning would be updated by the controller with the same voltage value. By measuring the difference between the desired value used to update the pixels and the measured value coming from the sensor pixels, a representative value for the feedthrough voltage is obtained.

Figure 5:
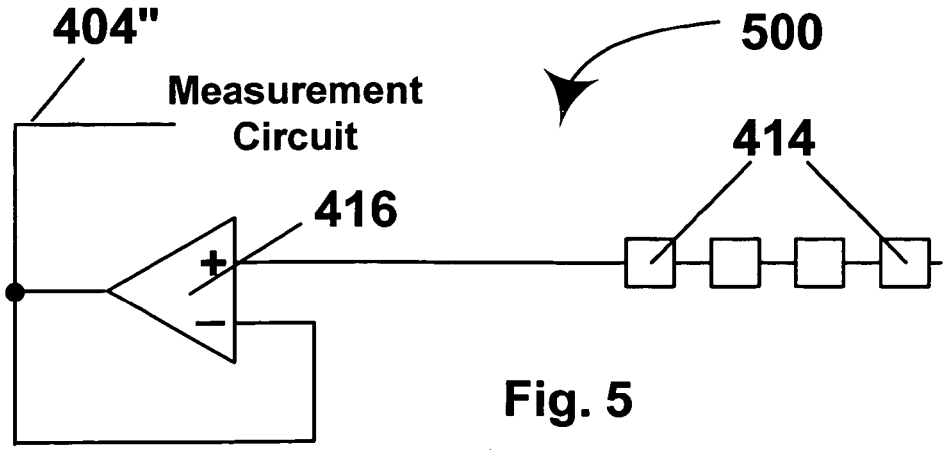
FIG. 5 is a partial circuit diagram of a display provided with means for measuring feedthrough voltage.

FIG. 5 shows a simple circuit (generally designated 500) for this purpose. By comparing FIG. 5 with FIG. 4, it will be seen that the circuit of FIG. 5 is substantially similar to part of the control means 400 of FIG. 4, except for the destination of the final output signal, and to avoid repetition the integers in FIG. 5 are given the same reference numerals as in FIG. 4. The circuit of FIG. 5 comprises a plurality of sensor pixels 414 and a differential amplifier 416. However, the output from amplifier 416 is sent over a line 404" to a measurement circuit. Given the relationship between the control means 400 and the circuit 500, it will be appreciated that the sensor pixel measuring method could be carried out by temporarily connecting line 404' of control means 400 to the measuring circuit while carrying out the gate feedthrough voltage measurement (since switch S1 is open during the measurement, line 402 need not be connected at this time) and thereafter adjusting the voltage $V_{COM}$ provided on line 402 in accordance with the measured value of the gate feedthrough voltage.

Alternatively, the gate feedthrough voltage may be measured by allowing the common electrode to float (i.e., disconnecting it from all conductors), and updating the entire pixel electrode array with a single voltage for a period long enough for current leakage through the electro-optic medium layer to charge the common electrode to a voltage equal to the pixel electrode voltage. A measuring circuit can then measure the difference between the column driver voltage (the voltage used to drive the source lines during scanning) and the output voltage from the floating common electrode, and thus determine an area weighted average of the gate feedthrough voltage.

Figure 6:
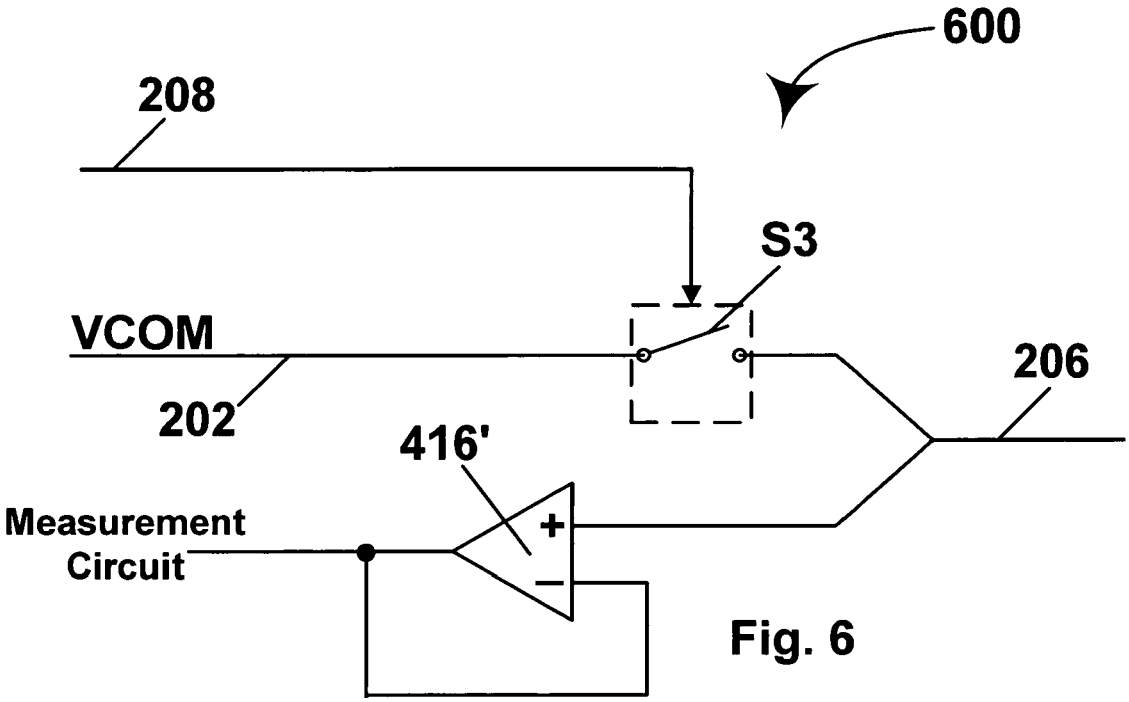
FIG. 6 is a partial circuit diagram of a modified version of the display of FIG. 2 provided with means for measuring feedthrough voltage.

FIG. 6 shows a simple circuit (generallly designated 600) for carrying out this measuring procedure. By comparing FIG. 6 with FIGS. 2 and 5, it will be seen that circuit 600 is essentially control means 200 of FIG. 2 modified by the addition of a differential amplifier 416' and a line leading from this amplifier to a measuring circuit, the amplifier 416', the line and the measurement circuit operating in the same way as the corresponding integers in FIG. 5, and the various integers in FIG. 5 are numbered accordingly. It is possible to carry out the measuring procedure by temporarily connecting output line 206 of the control means 200 shown in FIG. 2 to an appropriate testing unit comprising the differential amplifier and measuring circuit. During the measuring procedure, the control signal on line 208 should be set to open switch S3, thus disconnecting the common electrode from its driving circuit. Similarly, S3 can also be used to provide a display "sleep" state, as described above.

With either the sensor pixel or the floating common electrode measurement method, a very low leakage current method of measuring the output voltage from the sensor pixel or common electrode is needed in order avoid errors in the measured value of the gate feedthrough voltage. A preferred method for such voltage measurement is to connect a high impedance voltage follower circuit between the sensor pixel or common electrode and the measuring circuit.

Figure 7:
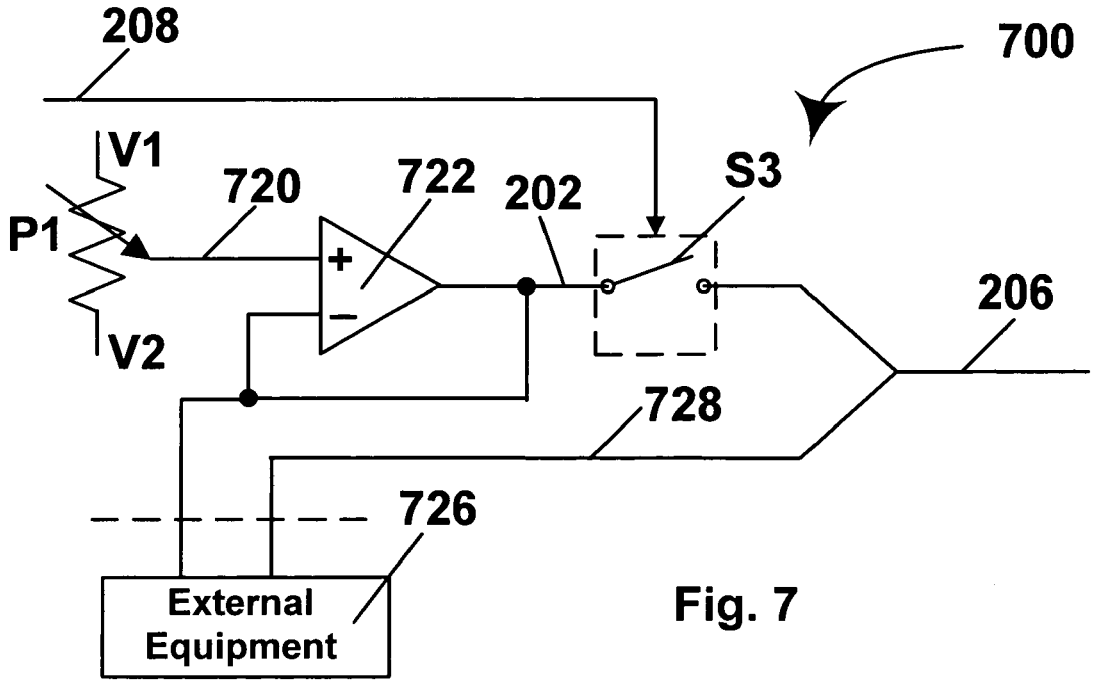
FIG. 7 is a partial circuit diagram of a display of the present invention to adjusted with external equipment to compensate for feedthrough voltage.

Methods for adjusting voltage inputs to adjust for measured gate feedthrough voltages will now be described. The most straightforward way to compensate for the feedthrough voltage (and indeed to measure such voltage) is to connect the display to external equipment once the display has been assembled complete with its drivers. FIG. 7 of the accompanying drawings shows an appropriate circuit (generally designated 700) for this purpose incorporated into a basic control means of the type shown in FIG. 2 and including a voltage supply line 202, a control line 208, a switch S3 and an output line 206, all of which are identical to the corresponding integers in FIG. 2. To provide an appropriate value of $V_{COM}$ on line 202, a manual potentiometer P1 is connected between voltages V1 and V2, such that the output of the potentiometer wiper on a line 720 can span the range of $V_{COM}$ values corresponding to the full range of possible feedthrough voltages. The line 720 is connected to the positive input of a voltage follower comprising a differential amplifier 722 having its output connected to both line 202 and its negative input. The output of amplifier 202 is also connected via a line 724 to external measuring equipment 726, which also receives the common electrode voltage from line 206 via a line 728.

To set an appropriate value of $V_{COM}$ on voltage input line 202 in circuit 700, the display may be scanned continuously with all the pixel electrodes set to their midpoint voltage (often 0 V), and with the control signal on line 208 set to keep switch S3 open and the display disconnected from the driving circuit formed by potentiometer P1 and amplifier 722. The external equipment 726 measures and compares the common electrode voltage present on lines 206 and 728 with the output voltage from amplifier 722 on lines 202 and 724. An operator turns the wiper of P1 until the external test equipment 726 indicates (via a green light, beeping sound, or other signal) that the difference between these two voltages is within an acceptable range.

As already indicated, the circuit 300 of FIG. 3 does include circuitry of the type shown in FIG. 7, with the combination of the potentiometer R9 and resistor R10 taking the place of potentiometer P1 and the pin 1/2/3 section of IC 330 taking the place of amplifier 722.

Potentiometer P1 in FIG. 7 could be replaced with a digital potentiometer. The test equipment could then automatically adjust the potentiometer value through a dedicated interface or through the controller until the measured difference was within specifications. The potentiometer could either have a non-volatile memory or the final set point could be stored in the controller and used to initialize the potentiometer each time the display was powered up. In either case, the potentiometer could be located on a display module printed circuit board, rather than on a controller board, since feedthrough voltage is a function of the display, not the controller; thus, locating the potentiometer in this manner allows interchange of controllers among displays.

Various types of circuitry could be used in place of the potentiometer P1. For example, resistive traces or resistors could be placed in parallel and selectively cut, punched, or laser ablated to adjust the voltage set point. Alternatively, a digital/analogue mechanism, such as an R-2R ladder, a pulse modulator coupled to a low pass filter, or a true digital/analogue converter, could be used for this purpose. The external equipment could perform the measurement and comparison while interfacing to the controller to adjust the digital/analogue setting. Once the final setting was determined, it could be stored in the controller or in a small EEPROM or other non-volatile memory mounted on a display module printed circuit board.

Figure 8:
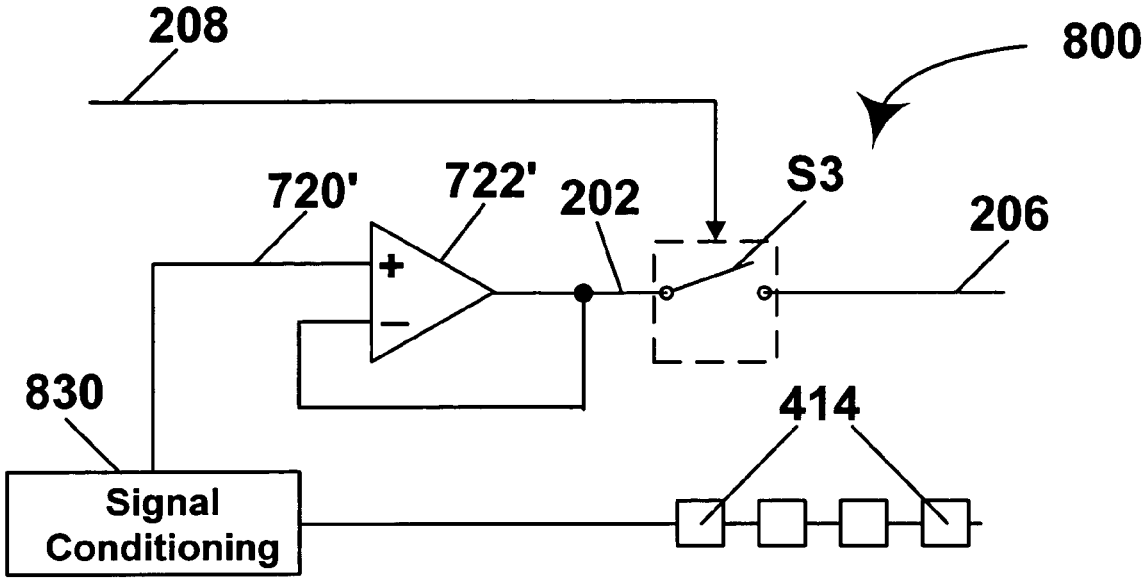
FIG. 8 is a partial circuit diagram of a display of the present invention in which compensation for feedthrough voltage is effected internally using sensor pixels.

Ideally, however, the display would not need to undergo this adjustment procedure while connected to external equipment, but would instead have an internal capability to adjust its common electrode voltage (or more accurately the offset of this voltage from the mid-point of the driver voltage range to allow for gate feedthrough), thus saving time and eliminating potential errors in manufacturing, and allowing multiple readjustments. One simple circuit (generally designated 800) providing such "internal adjustment" is illustrated in FIG. 8 of the accompanying drawings. The circuit 800 is essentially a modification of the circuit 700 shown in FIG. 7, with the lines 724 and 728, the external measuring equipment 726 and the potentiometer P1 all eliminated and replaced by a plurality of sensor pixels 414 (identical to those described above with reference to FIG. 4), and a signal conditioning unit 830 having its input arranged to receive the voltage from the sensor pixels 414 and its output on line 720' fed to an amplifier 722'.

The circuit 800 does not require digitizing the measured feedthrough voltage. Instead, the sensor pixels are used to give real time measurement of the voltage needed on the common electrode, in the same way as in the control means 400 shown in FIG. 4, with the active area of the display updated with variable image data, but the sensor pixels constantly written with $V_{SM}$, the mid-point of the column driver voltage range (often 0 V). The analog voltage generated by the sensor pixels 414 is optionally filtered by signal conditioning unit 830 and used to drive the common electrode through the voltage follower circuit provided by the amplifier 722' and line 206.

Figure 9:
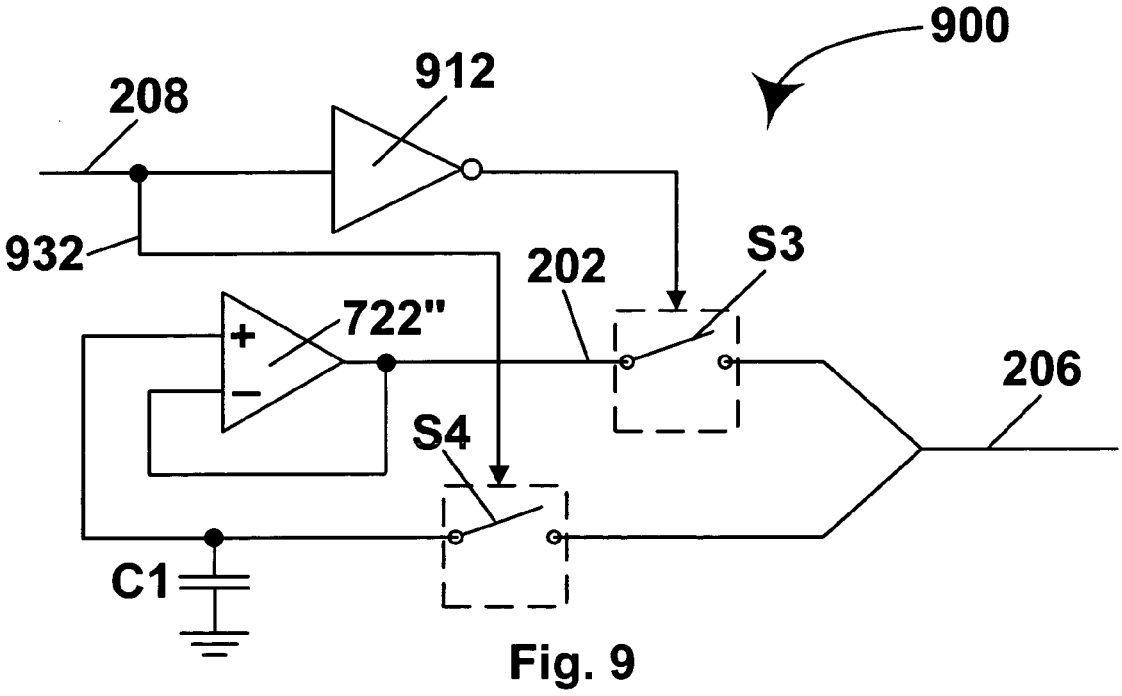
FIG. 9 is a partial circuit diagram of a modified version of the display of FIG. 1 provided with means for compensating for feedthrough voltage.

FIG. 9 of the accompanying drawings illustrates another approach to "internal adjustment" which does not require the presence of sensor pixels. The circuit (generally designated 900) shown in FIG. 9 may be regarded as derived from the circuit 800 of FIG. 8 by eliminating the sensor pixels 414 and signal conditioning unit 830, and substituting a capacitor C1 connected between the positive input of an amplifier 722" and ground, and also connected via a switch S4 to the output line 206. The switch S4 receives the control signal from line 208 via a line 932, while an inverter 912 is inserted between the control line 208 and switch S3. (Because of the presence of the inverter 912, the control signals on line 208 need to be inverted in circuit 900 as compared with circuit 800. Alternatively, of course, the inverter could be inserted in line 932 and the control signals remain unchanged.)

The circuit 900 is operated as follows. First, the display is scanned with all column electrodes set to $V_{SM}$, and switch S4 closed and switch S3 open, so that capacitor C1 charges to the common electrode voltage $V_{COM}$. Next, the signal on the control line 208 is changed to open S4 and close S3, while writing a real image on the display, With S4 open, the voltage follower provided by amplifier 722" ensures that the voltage $V_{COM}$ stored on capacitor C1 also appears on lines 202 and 206, and thus on the common electrode. If needed, an additional voltage follower may be inserted between S4 and C1. Thus, the combination of switch S4 and capacitor C1 acts as an analog sample-and-hold circuit, the output of which is used to drive the common electrode during updating of the display. This approach has the disadvantage of requiring that a few blank frames be scanned periodically, perhaps even before every image update, in order to maintain the voltage on capacitor C1 at the desired value, and such scanning of blank frames increases the time needed for image updates.

As already indicated, the circuit 300 shown in FIG. 3 is equipped for gate feedthrough correction in a manner similar to that of the circuit 900 shown in FIG. 9, with the capacitor C1 in circuit acting in the same manner as capacitor C1 in circuit 900, and switching of the HVEN signal in circuit 300 taking the place of the switch S4 in circuit 900.

Figure 10:
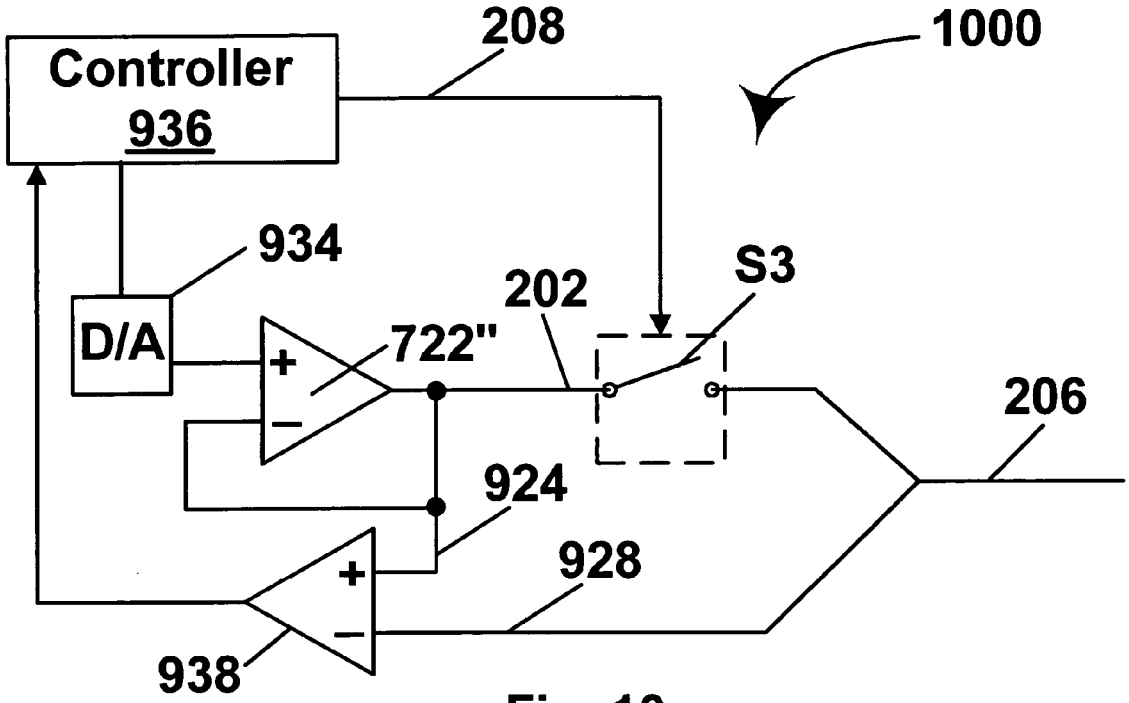
FIG. 10 is a partial circuit diagram of a display of the present invention in which compensation for feedthrough voltage is effected digitally.

In contrast to the analog sample-and-hold approach used in circuit 900, a digital controller can servo its digital/analogue mechanism to make the voltage offset between $V_{SM}$ and $V_{COM}$ closely match the feedthrough voltage. A circuit (generally designated 1000) of this type is illustrated in FIG. 10. This circuit 1000 may be considered as a modification of the circuit 700 shown in FIG. 7, with the potentiometer P1 replaced by a DAC 934, which receives digital input from a controller 936. Also, the external measuring equipment 726 is replaced by a comparator 938, the positive input of which receives the output from amplifier 722 on line 924, while the negative input of comparator 938 is connected via line 928 to the output line 206. The output from comparator 938 is fed to the controller 936.

Determining the appropriate voltage $V_{COM}$ to place upon lines 202 and 206 in circuit 1000 is effected in a manner generally similar to that used in the circuit 900. The control signal on line 208 is adjusted by controller 936 to open switch S3, and one or more scans of the display are effected with all column drivers set to $V_{SM}$. The controller 936 first sets the output of DAC 934 to one extreme of its range, and then either steps successively through all possible output values of DAC 934, or (perhaps better) uses a successive approximation technique to find the two output values of DAC 934 between which the single bit output of comparator 938 changes. The controller 936 then sets the output of DAC 934 to one of these two values, closes switch S3 and commences updating of the image on the display. Depending upon the accuracy and resolution of the circuitry, this procedure will reduce the difference between the value of $V_{COM}$ actually placed on output line 206 and the value theoretically required in view of $V_{SM}$ and the gate feedthrough voltage to an acceptably low level.

In circuit 1000, the comparator 938 could be replaced by a full DAC, but the use of the single analogue comparator 938 is preferred on grounds of cost.

From the foregoing, it will be seen that the present invention provides apparatus and methods for measuring and compensating for the feedthrough voltage of electro-optic displays, thereby avoiding the deleterious effects which may be produced in such displays if the feedthrough voltage is not accurately compensated.

Numerous changes and modifications can be made in the preferred embodiments of the present invention already described without departing from the spirit and skill of the invention. Accordingly, the foregoing description is to be construed in an illustrative and not in a limitative sense.

The invention claimed is:

1. An electro-optic display comprising:

a layer of a bistable electro-optic medium;

a plurality of pixel electrodes disposed on one side of the layer of electro-optic medium, at least one non-linear element associated with each pixel electrode;

pixel drive means arranged to apply voltages to the pixel electrodes via the non-linear elements;

a common electrode on the opposed side of the layer of electro-optic medium from the pixel electrodes; and common electrode control means arranged to apply voltages to the common electrode, the display having a writing mode, in which the pixel drive means applies at least two different voltages to different ones of the pixel electrodes, thereby writing an image on the electro-optic medium, and a non-writing mode in which the pixel drive means controls the voltages applied to the pixel electrodes so that any image previously written on the electro-optic medium is substantially maintained, the common electrode control means being arranged to apply to the common electrode a first voltage when the display is in its writing mode and a second voltage, different from the first voltage, when the display is in its non-writing mode.

2. An electro-optic display comprising:

a layer of a bistable electro-optic medium;

a plurality of pixel electrodes disposed on one side of the layer of electro-optic medium, at least one non-linear element associated with each pixel electrode;

pixel drive means arranged to apply voltages to the pixel electrodes via the non-linear elements;

a common electrode on the opposed side of the layer of electro-optic medium from the pixel electrodes; and common electrode control means arranged to apply voltages to the common electrode, the display having a writing mode, in which the pixel drive means applies at least two different voltages to different ones of the pixel electrodes, thereby writing an image on the electro-optic medium, and a non-writing mode in which the pixel drive means controls the voltages applied to the pixel electrodes so that any image previously written on the electro-optic medium is substantially maintained, the common electrode control means being arranged to apply to the common electrode a first voltage when the display is in its writing mode and a second voltage, different from the first voltage, when the display is in its non-writing mode, the display further comprising:

a first voltage supply line arranged to supply the first voltage;

a second voltage supply line arranged to supply the second voltage;

an output line;

switching means for connecting one of the first and second voltage supply lines to the output line; and a control line connected to the switching means and arranged to receive a control signal having a first or a second value, the switching means being arranged to connect the output line to the first voltage supply line when the control signal has the first value and to connect the output line to the second voltage supply line when the control signal has the second value.

3. An electro-optic display according to claim 2 wherein the output line is connected to the common electrode.

4. An electro-optic display according to claim 2 wherein the output line is arranged to control the mid-point of the voltage range of the pixel drive means.

5. An electro-optic display according to claim 1 wherein a capacitor is associated with each pixel electrode, and one electrode of each capacitor is arranged to receive the same voltage as the common electrode.

6. An electro-optic display comprising:

a layer of a bistable electro-optic medium;

a plurality of pixel electrodes disposed on one side of the layer of electro-optic medium, at least one non-linear element associated with each pixel electrode;

pixel drive means arranged to apply voltages to the pixel electrodes via the non-linear elements:

a common electrode on the opposed side of the layer of electro-optic medium from the pixel electrodes; and common electrode control means arranged to apply voltages to the common electrode, the display having a writing mode, in which the pixel drive means applies at least two different voltages to different ones of the pixel electrodes, thereby writing an image on the electro-optic medium, and a non-writing mode in which the pixel drive means controls the voltages applied to the pixel electrodes so that any image previously written on the electro-optic medium is substantially maintained, the common electrode control means being arranged to apply to the common electrode a first voltage when the display is in its writing mode and a second voltage, different from the first voltage, when the display is in its non-writing mode the display further comprising:

a voltage supply line arranged to supply the first voltage;

an output line connected to the common electrode;

switching means for connecting the voltage supply line to the output line; or for disconnecting the output line from the voltage supply line; and a control line connected to the switching means and arranged to receive a control signal having a first or a second value;

the switching means being arranged to connect the output line to the voltage supply line when the control signal has the first value and to disconnect the output line from the voltage supply line when the control signal has the second value.

7. An electro-optic display according to claim 3 further comprising at least one sensor pixel having an associated sensor pixel electrode arranged to receive the second voltage, the at least one sensor pixel being connected to the second voltage supply line.

8. An electro-optic display according to claim 7 further comprising a differential amplifier having its positive input connected to the at least one sensor pixel, and its output connected to both its negative input and the second voltage supply line.

9. An electro-optic display comprising:

a layer of a bistable electro-optic medium;

a plurality of pixel electrodes disposed on one side of the layer of electro-optic medium, at least one non-linear element associated with each pixel electrode;

pixel drive means arranged to apply voltages to the pixel electrodes via the non-linear elements;

a common electrode on the opposed side of the layer of electro-optic medium from the pixel electrodes; and common electrode control means arranged to apply voltages to the common electrode, the display having a writing mode, in which the pixel drive means applies at least two different voltages to different ones of the pixel electrodes, thereby writing an image on the electro-optic medium, and a non-writing mode in which the pixel drive means controls the voltages applied to the pixel electrodes so that any image previously written on the electro-optic medium is substantially maintained, the common electrode control means being arranged to apply to the common electrode a first voltage when the display is in its writing mode and a second voltage, different from the first voltage, when the display is in its non-writing mode, the display further comprising bias supply circuitry arranged to supply the first and second voltages, and means for shutting down the bias supply circuitry when the display is in its non-writing mode.

10. An electro-optic display according to claim 9 wherein the pixel electrodes are arranged to receive the same voltage as the common electrode during shut down and powering up of the bias supply circuitry.

11. An electro-optic display according to claim 1 wherein the electro-optic layer comprises a rotating bichromal member or electrochromic display medium.

12. An electro-optic display according to claim 1 wherein the electro-optic layer comprises a particle-based electrophoretic material comprising a suspending fluid and a plurality of electrically charged particles suspended in the suspending fluid and capable of moving therethrough on application of an electric field to the electrophoretic material.

13. An electro-optic display according to claim 12 wherein the electrophoretic material is an encapsulated electrophoretic material in which the suspending fluid and the electrically charged particles and encapsulated within a plurality of capsules, each of the capsules having a capsule wall.

14. An electro-optic display according to claim 12 wherein the suspending fluid and the electrically charged particles are retained within a plurality of cells formed in a substrate.

15. A method of operating an electro-optic display which comprises: a layer of a bistable electro-optic medium; a plurality of pixel electrodes disposed on one side of the layer of electro-optic medium, each pixel electrode having at least one non-linear element associated therewith; and a common electrode on the opposed side of the layer of electro-optic medium from the pixel electrodes, the method comprising: applying a first voltage to the common electrode while applying at least two different voltages to different ones of the pixel electrodes, thereby writing an image on the electro-optic medium; and applying a second voltage, different from the first voltage, to the common electrode during a non-displaying mode of the display, while controlling the voltages applied to the pixel electrodes so that any image previously written on the entire display of the electro-optic medium is substantially maintained.

16. A method of operating an electro-optic display which comprises: a layer of a bistable electro-optic medium; a plurality of pixel electrodes disposed on one side of the layer of electro-optic medium, each pixel electrode having at least one non-linear element associated therewith; a common electrode on the opposed side of the layer of electro-optic medium from the pixel electrodes, and a voltage supply line for supplying voltage to the common electrode, the method comprising:

applying a first voltage to the common electrode while applying at least two different voltages to different ones of the pixel electrodes, thereby writing an image on the electro-optic medium; and controlling the voltages applied to the pixel electrodes so that any image previously written on the electro-optic medium is substantially maintained, while disconnecting the common electrode from the voltage supply line, thereby allowing the voltage on the common electrode to float.

17. An electro-optic display comprising:

a layer of a bistable electro-optic medium;

a plurality of pixel electrodes disposed on one side of the layer of electro-optic medium, at least one of the pixel electrodes being a sensor pixel electrode;

at least one non-linear element associated with each pixel electrode;

pixel drive means arranged to apply voltages to the pixel electrodes via the non-linear elements, the pixel drive means being arranged to apply a predetermined voltage to the at least one sensor pixel electrode;

a common electrode on the opposed side of the layer of electro-optic medium from the pixel electrodes; and common electrode voltage control means arranged to receive a signal representative of the voltage on the at least one sensor pixel electrode and to vary the voltage applied to the common electrode in dependence upon said signal.

18. A method according to claim 16 wherein the layer of electro-optic medium comprises a rotating bichromal member or electrochromic display medium.

19. A method according to claim 16 wherein the layer of electro-optic medium comprises a particle-based electrophoretic material comprising a suspending fluid and a plurality of electrically charged particles suspended in the suspending fluid and capable of moving therethrough on application of an electric field to the electrophoretic material.

20. A method according to claim 19 wherein the electrophoretic material is an encapsulated electrophoretic material in which the suspending fluid and the electrically charged particles and encapsulated within a plurality of capsules, each of the capsules having a capsule wall.

21. An electro-optic display according to claim 19 wherein the suspending fluid and the electrically charged particles are retained within a plurality of cells formed in a substrate.

22. An electro-optic display according to claim 17 wherein the electro-optic layer comprises a rotating bichromal member or electrochromic display medium.

23. An electro-optic display according to claim 17 wherein the electro-optic layer comprises a particle-based electrophoretic material comprising a suspending fluid and a plurality of electrically charged particles suspended in the suspending fluid and capable of moving therethrough on application of an electric field to the electrophoretic material.

24. An electro-optic display according to claim 23 wherein the electrophoretic material is an encapsulated electrophoretic material in which the suspending fluid and the electrically charged particles and encapsulated within a plurality of capsules, each of the capsules having a capsule wall.

25. An electro-optic display according to claim 23 wherein the suspending fluid and the electrically charged particles are retained within a plurality of cells formed in a substrate.

* * * * *